US006839534B2

(12) United States Patent
Matsuda et al.

(10) Patent No.: US 6,839,534 B2
(45) Date of Patent: Jan. 4, 2005

(54) IMAGE FORMING APPARATUS AND DEVELOPER SUPPLY CONTAINER REMOVABLY MOUNTABLE IN IMAGE FORMING APPARATUS

(75) Inventors: Kenji Matsuda, Numazu (JP); Hisayoshi Kojima, Mishima (JP); Hironobu Isobe, Numazu (JP); Takashi Yahagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/940,441

(22) Filed: Aug. 29, 2001

(65) Prior Publication Data

US 2002/0031374 A1 Mar. 14, 2002

(30) Foreign Application Priority Data

Sep. 1, 2000 (JP) ..... 2000-265954

(51) Int. Cl.[7] ..... G03G 15/08

(52) U.S. Cl. ..... 399/262; 399/106

(58) Field of Search ..... 399/25, 27, 103, 399/106, 119, 120, 224, 252, 258, 262

(56) References Cited

U.S. PATENT DOCUMENTS

| | | | | |
|---|---|---|---|---|
| 5,363,177 A | * | 11/1994 | Nakano et al. | 399/106 |
| 5,555,080 A | * | 9/1996 | Elich et al. | 399/262 X |
| 5,708,912 A | * | 1/1998 | Lee | 399/27 |
| 5,737,675 A | * | 4/1998 | Okada et al. | 399/258 |
| 5,933,691 A | * | 8/1999 | Johroku | 399/262 |
| 5,970,284 A | * | 10/1999 | Garcia et al. | 399/120 |

FOREIGN PATENT DOCUMENTS

| | | | |
|---|---|---|---|
| JP | 6-95505 | | 4/1994 |
| JP | 11-095638 | * | 4/1999 |
| JP | 11-153904 | * | 6/1999 |

* cited by examiner

*Primary Examiner*—Sandra L. Brase
(74) *Attorney, Agent, or Firm*—Fitzpatrick, Cella, Harper & Scinto

(57) ABSTRACT

A developer supply container detachably mountable to an image forming apparatus, includes a developer accommodating portion; a developer discharging portion; and a cover cover in the developer discharging portion, the cover being movable between a first position in which the cover covers the developer discharging portion and a second position in which the developer discharging position is exposed, wherein the second position is closer to the developer accommodating portion than the first position.

10 Claims, 17 Drawing Sheets

IMAGE FORMING APPARATUS AND DEVELOPER SUPPLY CONTAINER REMOVABLY MOUNTABLE IN IMAGE FORMING APPARATUS

FIELD OF THE INVENTION AND RELATED ART

The present invention relates to an image forming apparatus such as a copying machine or a printer which employs an electrophotographic recording method, an electrostatic recording method, or the like. It also relates to a developer supply container removably mountable in such an image forming apparatus.

A large number of recent copying machines or printers employ a cartridge system, which simplifies the maintenance for an image forming apparatus.

For example, in a printer based on electrophotographic technologies, a photoconductive member, a developing device, and the like, are integrated in the form of a cartridge which is removably mountable in the main assembly of the printer. In some cases, only a photoconductive member and a cleaning device are integrated in the form of a cartridge, which is removably mountable in the main assembly of the printer, and a developing device is disposed in another cartridge which is also removably mountable in the main assembly of the printer. In other words, there are various cartridge types.

In some of the image forming apparatuses which employ the above described cartridge system, a developing device and a developer container are rendered independent from each other, making it possible to replenish an image forming apparatus with a fresh supply of developer, which is an expendable substance, by replacing a developer supply container, independently from a developing device. In these printers, some of the structural components, for example, a development roller, in a developing device, which are relatively durable, do not need to be replaced every time the printers are replenished with developer. In other words, the employment of the cartridge system has merit in that it reduces the image formation cost. It also reduces the size of the cartridge to be replaced, simplifying cartridge replacement.

However, the employment of the above described developer supply container system has a problem in that developer leaks when a developer supply container is removed from the main assembly of a printer. This problem of developer leakage must be dealt with.

Further, a developer supply container and a developing device, which are disposed next to each other in the image forming apparatus main assembly, must be mounted into, or removed from, the apparatus main assembly, independently from each other. This creates another problem in that when one of these two components is mounted or dismounted, the other interferes with the operation for mounting or dismounting the first one. This problem of operational inconvenience must also be eliminated.

SUMMARY OF THE INVENTION

The present invention was made in consideration of the above described problems. Its primary object is to provide a developer supply container which does not incur development leakage when it is removed from the main assembly of an image forming apparatus.

Another object of the present invention is to provide an image forming apparatus, into, or from, the main assembly of which a unit other than a developer supply container can be easily mounted, or removed, even when the developer supply container is in its proper position in the main assembly.

According to an aspect of the present invention, there is provided a developer supply container detachably mountable to an image forming apparatus, comprising a developer accommodating portion; a developer discharging portion; and a cover cover in said developer discharging portion, said cover being movable between a first position in which said cover covers said developer discharging portion and a second position in which said developer discharging position is exposed, wherein said second position is closer to said developer accommodating portion than said first position.

According to another aspect of the present invention, there is provided an image forming apparatus comprising an image bearing member; developing means for developing a latent image formed on said image bearing member; and developer supply container detachably mountable to a main assembly of said image forming apparatus, said container including; a developer accommodating portion; a developer discharging portion; and a cover in said developer discharging portion, said cover being movable between a first position in which said cover covers said developer discharging portion and a second position in which said developer discharging position is exposed, wherein said second position is closer to said developer accommodating portion than said first position.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the present invention will be described with reference to an electrophotographic color image forming apparatus. In the following description of the present invention, the lengthwise direction means the direction parallel to the axial direction of an electrophotographic photoconductive member (which hereinafter will be referred to as photoconductive drum 2). Further, with respect to the direction in which a cartridge is inserted into an electrophotographic image forming apparatus, the leading end will be referred to as the rear side, and with respect to the direction in which the cartridge is pulled out of the apparatus, the leading end will be referred to as the front side. Further, the top and bottom sides of a cartridge means the top and bottom sides of the cartridge when the cartridge is in the proper position in the apparatus main assembly.

General Description of Image Forming Apparatus

Figure 1:
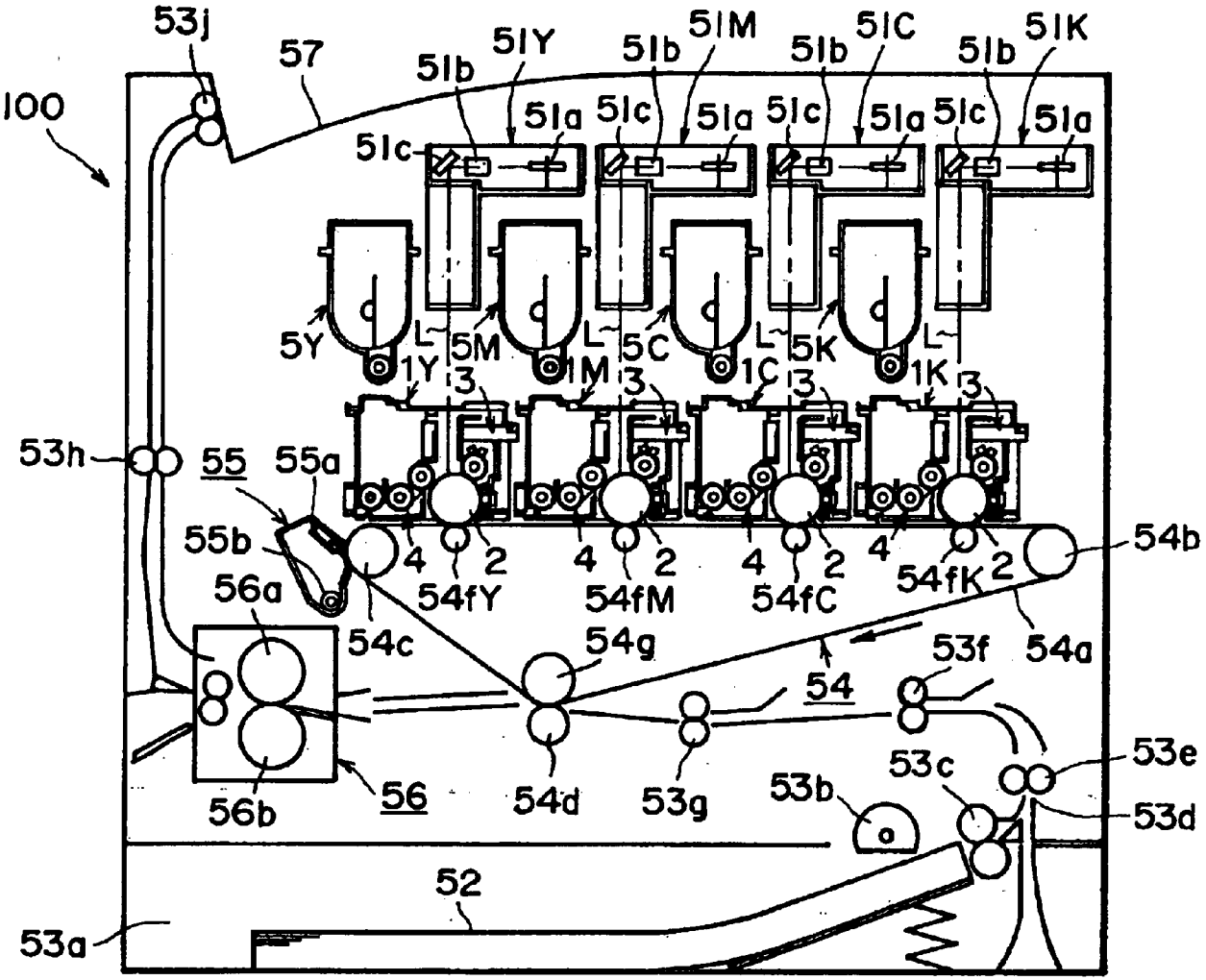
FIG. 1 is a vertical sectional view of the main assembly of an electrophotographic color image forming apparatus in accordance with the present invention.

First, referring to FIG. 1, the general structure of an electrophotographic color image forming apparatus will be described. FIG. 1 is a drawing for depicting the general structure of a color laser beam printer, which is a form of an electrophotographic color image forming apparatus.

The image forming station of this color laser beam printer has four process cartridges 1Y, 1M, 1C, and 1K (yellow, magenta, cyan, and black colors), each of which has a photoconductive drum as an image bearing member. The image forming apparatus also has four exposing means 51Y, 51M, 51C, and 51K (laser beam based optical scanning systems), which are disposed above the process cartridges 1Y, 1M, 1C, and 1K, corresponding one for one to the preceding process cartridges identical in alphabetical referential code.

Further, the image forming apparatus has a sheet feeding station for feeding a recording medium 52 into the main assembly of the image forming apparatus, an intermediary transfer belt 54*a* for transferring a toner image formed on the photoconductive drum 2, and a secondary transfer roller 54*d* for transferring a toner image on the intermediary transfer belt 54*a* onto the recording medium 52. The sheet feeding station, intermediary transfer belt 54*a*, and secondary transfer roller 54*d* are below the aforementioned image forming station.

Further, the color laser beam printer has a fixing means for fixing a toner image having been transferred onto the recording medium 52, and a discharging means for discharging the recording medium 52 from the apparatus main assembly and placing the recording media 52 in layers. The recording medium 52 is a sheet of paper, an OHP sheet, fabric, or the like.

The image forming apparatus in this embodiment is a cleaner-less apparatus. In other words, a cleaner dedicated for recovering and storing the transfer residual toner particles, that is, the toner particles which remain on the peripheral surface of the photoconductive drum 2, is not provided in a process cartridge, and the transfer residual toner particles are taken into the developing means.

Next, the structures of the various components of the above described image forming apparatus will be described in detail in the obvious order.

Feeding Station

The sheet feeding station is a station for delivering the recording medium 52 to the image forming station. Essentially, it comprises: a sheet feeder cassette 53*a* in which a plurality of recording media 52 are stored in layers; a sheet feeding roller 53*b*; a regarding roller pair 53*c* for preventing two or more recording media 52 from being delivered together; a sheet guide 53*d*; and a registration roller pair 53*g*.

The sheet feeding roller 53*b* is rotationally driven in synchronism with an image forming operation to feed the recording medium 52 one by one into the main assembly from the sheet feeding cassette 53*a* while separating the recording medium 52 at the top from the rest of the recording media 52 in the cassette 53*a*. Each recording medium 52 is prevented by the retard roller pair 53*c*, from being conveyed together with the other recording medium 52 or media 52. After being fed into the apparatus main assembly, the recording medium 52 is conveyed to the registration roller pair 53*g* by conveying roller pairs 53*e* and 53*f* while being guided by the sheet guide 53*d*.

During an image forming operation, the registration roller pair 53*g* carries out a predetermined sequence, which comprises two distinctive processes: a process in which the registration roller pair 53*g* is kept stationary to keep the recording medium 52 on standby, and a process in which the registration roller pair 53*g* is rotated to convey the recording medium 52 toward the intermediary transfer belt 54*a*. The registration roller pair 53*g* carries out this sequence so that a toner image and the recording medium 52 become aligned with each other for a transfer process, that is, the process which follows the toner image forming process.

Immediately after the conveyance of the recording medium 52, the registration roller pair 53*g* is not rotating. If the recording medium 52 is delivered askew to the registration roller pair 53*g*, it is straightened as it bumps into the nip of the registration roller pair 53*g*.

Process Cartridge

A process cartridge means a cartridge, which is removably mountable in the main assembly of an electrophotographic image forming apparatus, and in which a charging means, a developing means or a cleaning means, and an electrophotographic photoconductive drum, are integrally disposed. It also includes: a cartridge, which is removably mountable in the main assembly of an electrophotographic image forming apparatus, and in which at least one means among a charging means, a developing means, and a cleaning means, and an electrophotographic photoconductive drum, are integrally disposed; and a cartridge, which is removably mountable in the main assembly of an electrophotographic image forming apparatus, and in which at least a developing means, and an electrophotographic photoconductive drum, are integrally disposed. In this embodiment, the main assembly 100 of an image forming apparatus employs a cleaner-less system, which will be described later. Therefore, the process cartridge in this embodiment is such a cartridge in which a charging means, a developing means, and an electrophotographic photoconductive drum are integrally disposed, and which is removably mountable in the apparatus main assembly 100.

In each of the process cartridges 1Y, 1M, 1C, and 1K, a charging means and a developing means, and the photoconductive drum 2 are integrally disposed in such a manner that the charging means and developing means surround the peripheral surface of the photoconductive drum 2, that is, an image bearing member. This process cartridge 1 is enabled to be easily removed from the main assembly (which hereinafter will be referred to as apparatus main assembly 100) of an electrophotographic image forming apparatus by a user, so that it can be replaced as the service life of the photoconductive drum 2 expires. In this embodiment, whether or not the service life of the process cartridge 1 has expired is determined by counting the number of the rotations of the photoconductive drum 2, and a user is informed of the expiration of the service life of the photoconductive drum 2 as the photoconductive drum rotation count exceeds a predetermined number.

The photoconductive drum 2 in this embodiment is an organic photoconductive member which is negatively charged. It comprises a base member, a photoconductive layer, and a charge injection layer. The base member is a cylindrical, hollow aluminum drum 2*h*, which is approximately 30 mm in diameter. The photoconductive layer is an ordinary photoconductive layer coated on the peripheral surface of the aluminum base drum 2*h*. The charge injection layer is the outermost layer. The photoconductive drum 2 is rotationally driven at a predetermined process speed, which is approximately 117 mm/sec in this embodiment.

The charge injection layer is a coated layer of dielectric resin (binder) in which electrically conductive microscopic particles, for example, $SnO_2$, have been dispersed.

Figure 4:
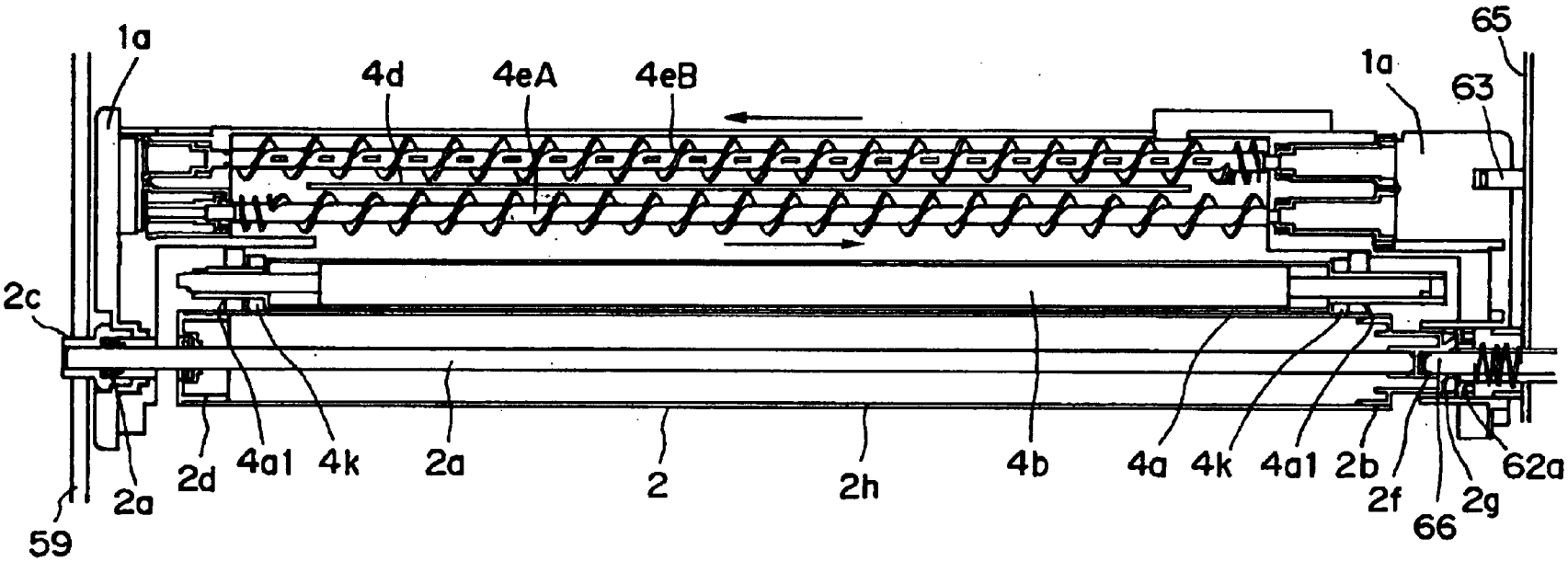
FIG. 4 is a vertical sectional view of the process cartridge in accordance with the present invention, at a vertical plane inclusive of the axial line of the photoconductive drum.

Referring to FIG. 4, the photoconductive drum 2 is provided with a drum flange 2*b* and a non-driven flange 2*d*. The drum flange 2*b* is fixed to the rear end (right-hand end in FIG. 4) of the base drum 2*h* of the photoconductive drum 2 in terms of the lengthwise direction of the photoconductive drum 2, and a non-driven flange 2*d* is fixed to the front end (left-hand end in FIG. 4). The photoconductive drum 2 also has a drum shaft 2*a*, which is put through the centers of the drum flange 2*b* and non-driven flange 2*d*. The drum shaft 2*a* and flange 2*d* are solidly fixed to each other. The base drum 2*h*, drum shaft 2*a*, drum flange 2*b*, and drum flange 2*d*, are rotated together. In other words, the photoconductive drum 2 is rotated about the axial line of the drum shaft 2*a*.

The front end of the drum shaft 2*a* is rotationally supported by a bearing 2*e*, which is fixed to a bearing case 2*c*. The bearing case 2*c* is fixed to the frame 1*a* of the process cartridge 1.

Charging Means

Figure 2:
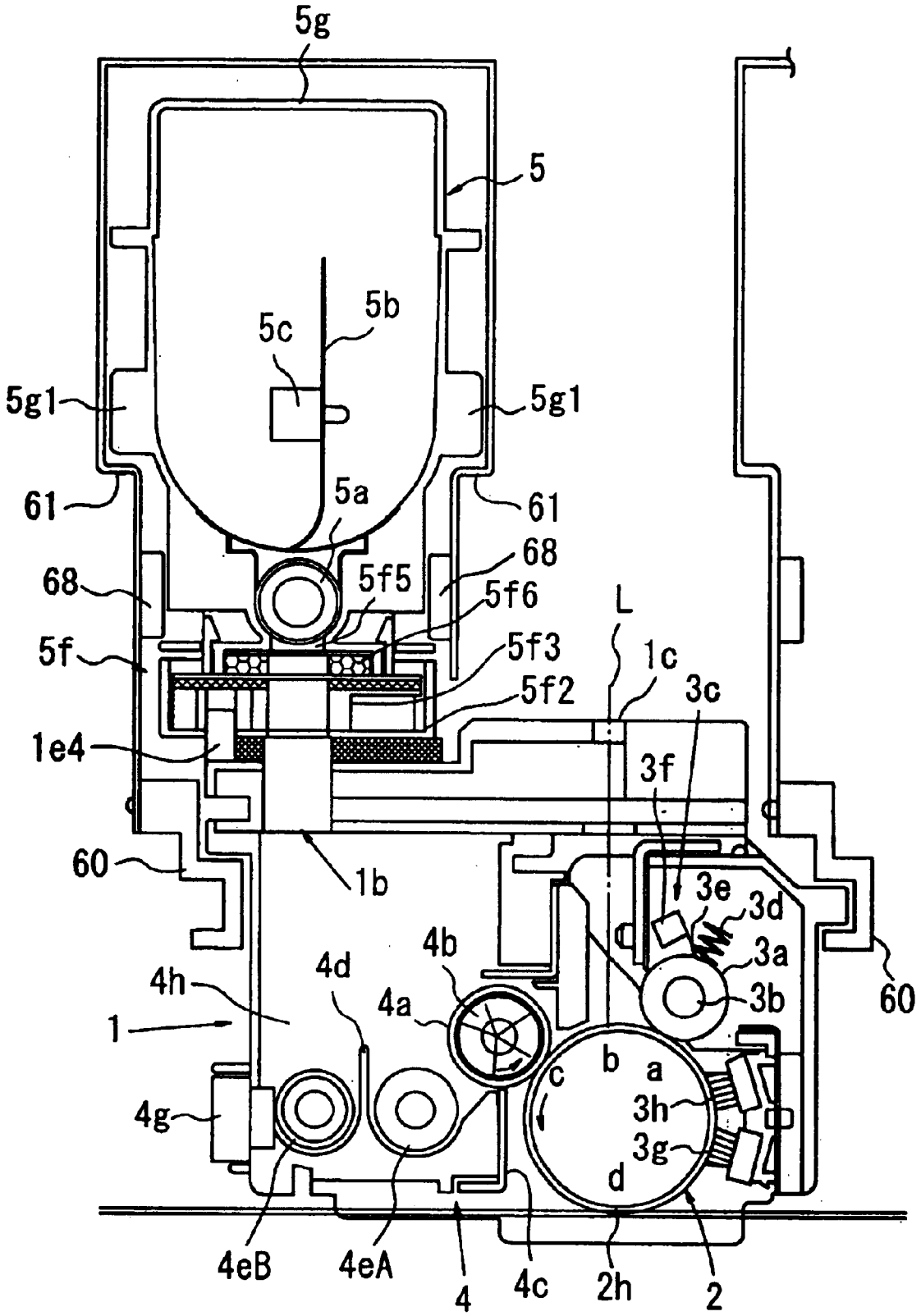
FIG. 2 is a vertical sectional view of a process cartridge and a toner supply container, which are in accordance with the present invention.

Referring to FIG. 2, the charging means in this embodiment is such a charging means that employs a contact charging method. It employs a charge roller 3*a* as a charging member. The charge roller 3*a* is rotationally supported by unshown bearings which support the lengthwise ends of the metallic core 3*b* of the charging roller 3*a*. It is kept under a predetermined amount of pressure generated by a pair of coil springs 3*d* in the direction of the photoconductive drum 2 so that the peripheral surface of the charge roller 3*a* is kept pressed upon the peripheral surface of the photoconductive drum 2. It rotates following the rotation of the photoconductive drum 2.

A referential code 3*c* designates a charge roller cleaning member, which comprises a supporting member 3*f*, and a flexible cleaning film 3*e* attached to the supporting member 3*f*. This cleaning film 3*e* is rectangular and is disposed in a manner to extend in parallel to the lengthwise direction of the charge roller 3*a*. It is fixed, by one of its long edges, to the supporting member 3*f* so that its surface adjacent to the other long edge, or the free long edge, forms a contact nip against the peripheral surface of the charge roller 3*a*. The supporting member 3*f* is enabled to reciprocally move a predetermined distance in the direction parallel to its lengthwise direction. As the supporting member 3*f* is driven by an unshown driving means in a manner to reciprocally move a predetermined distance in its lengthwise direction, the peripheral surface of the charge roller 3*a* is rubbed by the cleaning film 3*e*. As a result, the foreign substances (microscopic toner particles, additives, and the like) which have adhered to the peripheral surface of the charge roller 3*a* are removed.

The image forming apparatus in this embodiment employs a cleaner-less cleaning system. Next, this cleaner-less cleaning system will be described.

Cleaner-less Cleaning System

Referring to FIG. 2, the gist of the cleaner-less cleaning system of the image forming apparatus in this embodiment will be described. This cleaner-less cleaning system is such a cleaning system that removes the transfer residual toner particles on the photoconductive drum 2 by the developing means at the same time as the photoconductive drum 2 is charged by the developing means. More specifically, after the image transfer, the transfer residual toner particles on the photoconductive drum 2 are carried to a development station c, past the charge station a and an exposure station b, by the subsequent rotation of the photoconductive drum 2, and are removed by the developing means as the photoconductive drum 2 is charged by the developing means in the development station c.

Since the transfer residual toner particles on the peripheral surface of the photoconductive drum 2 pass through the exposure station b, the exposing process is carried out with the presence of the transfer residual toner particles on the peripheral surface of the photoconductive drum 2. But, the amount of the transfer residual toner particles on the peripheral surface of the photoconductive drum 2 is not large enough to significantly affect the exposing process. However, the transfer residual toner is a mixture of positively charged toner particles and negatively (reversely) charged toner particles. Further, some of the transfer residual toner particles are smaller in the amount of charge than the others. Thus, it is possible that as the reversely charged transfer residual toner particles and/or insufficiently charged transfer residual toner particles, on the peripheral surface of the photoconductive drum 2, pass through the charge station a, they adhere to the charge roller 3*a*. If the charge roller 3*a* is contaminated beyond a certain level by the adhesion of the transfer residual toner particles, the charge roller 3*a* fails to properly charge the photoconductive drum 2. Further, in order to improve the efficiency with which the transfer residual toner particles on the peripheral surface of the photoconductive drum 2 are removed by the developing apparatus at the same time as the photoconductive drum 2 is charged by the developing apparatus, it is necessary that the transfer residual toner particles on the photoconductive drum 2, which are carried to the development station c, are positive in polarity, and the amount of the charge of each transfer residual toner particle is proper for the developing apparatus to develop the electrostatic latent image on the photoconductive drum 2. The reversely charged toner particles, and the toner particles which are not proper in the amount of charge, cannot be removed or recovered from the photoconductive drum 2 by the developing apparatus, which results in the formation of a low quality image.

In recent years, user needs have diversified. For example, the user need for printing such an image as a photographic image that requires an image forming apparatus to be continually operated at a high printing ratio has begun to increase. Thus, with the diversification of user needs, the above described problem has begun to widely manifest, since the continual operation of an image forming apparatus at a high printing ratio produces a large amount of transfer residual toner all at once.

Thus, in order to evenly disperse the transfer residual toner particles on the peripheral surface of the photoconductive drum 2, across the peripheral surface of the photoconductive drum 2, the image forming apparatus in this embodiment is provided with a transfer residual toner particle dispersing means 3*g*, which is disposed in the adjacencies of the peripheral surface of the photoconductive drum 2, on the downstream side of the transfer station d in terms of the rotational direction of the photoconductive drum 2. Further, the image forming apparatus is provided with a toner charge controlling means 3*h* for unifying in polarity the transfer residual toner (developer) particles. The toner charge controlling means 3*h* is disposed in the adjacencies of the peripheral surface of the photoconductive drum 2, on the downstream side of the transfer residual toner particle dispersing means 3*g* and on the upstream side of the charge station a, in terms of the rotational direction of the photoconductive drum 2. The toner charge controlling means 3*h* rectifies the polarities of the reversely charged transfer residual toner particles to the negative polarity, or the normal polarity.

With the provision of the transfer residual toner dispersing means 3*g*, the transfer residual toner particles, which have been dispersed in a certain pattern and are carried from the transfer station d to the toner charge controlling means 3*h*, are evenly dispersed across the peripheral surface of the photoconductive drum 2 even if the amount of the transfer residual toner particles is large. In other words, the transfer residual toner particles, which have been distributed in a certain pattern on the peripheral surface of the photoconductive drum 2, are 5 evenly dispersed across the peripheral surface of the photoconductive drum 2, being therefore prevented from being concentrated to certain portions of the toner charge controlling means 3*h*, assuring that all the transfer residual toner particles are unified in polarity, being charged to the normal polarity. Therefore, the efficiency with which the transfer residual toner particles are prevented from adhering to the charge roller 3*a* is improved. Consequently, the formation of a ghost image, that is, the ghostly 15 pattern in a completed image, for which the transfer residual toner particles are responsible, is prevented.

In this embodiment, the transfer residual toner particle dispersing means 3*g* and toner charge controlling means 3*h* are given a proper amount of electrical conductivity, and are in the form of a brush. They are disposed so that their actual brush portions remain in contact with the peripheral surface of the photoconductive drum 2.

These means are enabled to be moved (reciprocated) by unshown driving power source in the lengthwise direction of the photoconductive drum 2 so that the transfer residual toner particle dispersing means 3*g* and toner polarity controlling means 3*h* are prevented from remaining at the same positions relative to the peripheral surface of the photoconductive drum 2. Thus, even if the toner charge controlling means 3*h* is not uniform in electrical resistance, and therefore, has portions with excessive charging capacity and portions with insufficient charging capacity, these portions do not remain at the same positions relative to the peripheral surface of the photoconductive drum 2. Consequently, the possibility that a microscopic amount of the transfer residual toner particles will be fused to certain portions of the peripheral surface of the photoconductive drum 2 by being overcharged, or remains adhered to certain portions of the peripheral surface of the charge roller 3*a* by being undercharged, is eliminated or reduced.

Exposing Means

In this embodiment, the photoconductive drum 2 is exposed with the use of a laser based exposing means. More specifically, image signals are sent to the exposing means from the image forming apparatus main assembly 100. As the signals are sent to the exposing means, a laser beam L modulated with the image signals is projected in a manner to uniformly scan the uniformly charged peripheral surface of the photoconductive drum 2. As a result, the uniformly charged peripheral surface of the photoconductive drum 2 is selectively exposed. Consequently, an electrostatic latent image in accordance with the image formation data is formed on the peripheral surface of the photoconductive drum 2.

Referring to FIG. 1, the laser based exposing means comprises a solid state laser element (unshown), a polygon mirror 51*a*, a focusing lens 51*b*, a reflection mirror 51*c*, and the like. The solid state laser element is turned on and off by a light emitting signal generating device (unshown) in response to the inputted image signals. The laser beam L emitted from the solid state laser element is converted by a collimator lens system (unshown) into a flux of virtually parallel light, is deflected in a manner to make a scanning movement, by the polygon mirror 51*a* which is being rotated at a high speed, and is focused in the form of a spot on the peripheral surface of the photoconductive drum 2 by way of the focusing lens 51*b* and deflection mirror 51*c*.

Since the photoconductive drum 2 is rotated while its peripheral surface is exposed to the scanning laser beam L, not only is the peripheral surface of the photoconductive drum 2 scanned by the laser beam L in the primary direction, or the moving direction of the laser beam L, but it also is scanned in the secondary direction, or the rotational direction of the photoconductive drum 2. As a result, the peripheral surface of the photoconductive drum 2 is exposed in a manner to reflect the sequential image signals. In other words, the uniformly charged peripheral surface of the photoconductive drum 2 is divided into light potential portions, that is, the portions, the surface potential of which has been reduced by the exposure to the laser beam L, and dark potential portions, that is, the portions, the surface potential of which has not been reduced by the laser beam L. Consequently, an electrostatic latent image in accordance with the image formation data emerges due to the contrast between the light potential portions and dark potential portions.

Developing Apparatus

The developing apparatus 4 in this embodiment is a contact type developing apparatus which uses a two component developer (two component magnetic brush type 20 developing apparatus). Referring to FIG. 2, it comprises a development sleeve 4*a* as a developer bearing member, a magnetic roller 4*b* disposed in the hollow of the development sleeve 4*a*, and developer, that is, a mixture of carrier and toner, which is 25 borne on the peripheral surface of the development sleeve 4*a*. This development sleeve 4*a* constitutes the developing means. The developing apparatus 4 is also provided with a regulating blade 4*c*, which is disposed a predetermined gap away from the peripheral surface of the development sleeve 4*a* so that as the development sleeve 4*a* is rotated in the direction of an arrow mark, a thin layer of the developer is formed on the peripheral surface of the development sleeve 4*a*. Incidentally, even though a two component magnetic brush type developing apparatus is employed as the developing apparatus 4 in this embodiment, the developing apparatus choice is not limited to this type of developing apparatus.

Referring to FIG. 4, the development sleeve 4*a* has a pair of journal portions 4*a*1, which are located at the lengthwise ends of the development sleeve 4*a* one for one. The smaller diameter portion of each journal portion 4*a*1 is fitted with a rotational spacer ring 4*k* in the form of a hollow roller so that a predetermined gap is maintained between the peripheral surfaces of the development sleeve 4*a* and photoconductive drum 2 to allow the layer of developer formed on the peripheral surface of the development sleeve 4*a* to make contact with the peripheral surface of the photoconductive drum 2 to develop the latent image on the peripheral surface of the photoconductive drum 2. Referring to FIG. 2, the development sleeve 4*a* is rotationally driven at a predetermined peripheral velocity in the counterclockwise direction indicated by an arrow mark so that the moving direction of the peripheral surface of the development sleeve 4*a* in the development station becomes counter to the moving direction of the peripheral surface of the photoconductive drum 2 in the development station.

The toner employed in this embodiment is 6 $\mu$m in average particle diameter, and is negatively charged. The magnetic carrier employed in this embodiment is 35 $\mu$m in average particle diameter and is 205 emu/cm$^3$ in saturation magnetization. The toner and carrier are mixed at a weight ratio of 6:94 to be used as the developer. Developer choice does not need to be limited to a mixture of toner and magnetic carrier. For example, magnetic toner may be employed.

Referring to FIG. 2, a developer holding portion 4*h*, in which the developer is circulated, is divided by a partitioning wall 4*d* into a two chambers. The partitioning wall 4*d* extends in the lengthwise direction of the process cartridge 1 from one end of the developer holding portion 4*h* to the other for the immediate adjacencies of the end walls of the developer holding portion 4*h*. The developer holding portion 4*h* is provided with a pair of stirring screws 4*e*A and 4*e*B, which are disposed in a manner to sandwich the partitioning wall 4*d*.

Referring to FIG. 4, as toner is supplied into the developer holding portion 4*h* from a toner supply container 5, it falls into the rear side (right side in FIG. 4) of stirring screws 4*e*B, and is sent toward the front side (left side in FIG. 4) while being stirred. As the toner reaches the front end of the toner holding portion 4*h*, it moves into the other side of the partition wall 4*d*, past the gap between the front end of the partition wall 4*d* and the front wall of the developer holding portion 4*h*. Then, it is sent by the stirring screw 4*e*A to the rear end (right side in FIG. 4). As it reaches the rear end of the developer holding portion 4*h*, it moves into the side into which it fell from the toner supply container 5, and is sent again by the stirring screw 4*e*B toward the front end to be re-circulated.

At this time, the development process for visualizing an electrostatic latent image formed on the photoconductive drum 2, with the use of the developing apparatus 4 which employs a two component magnetic brush based developing method, and the developer circulating system, will be described with reference to FIG. 2. As the development sleeve 4*a* is rotated, the developer within the developer holding portion 4*h* is picked up in a layer by the pickup pole of the magnetic roller 4*b* onto the peripheral surface of the development sleeve 4*a*, and is conveyed toward the development station.

As the layer of developer on the peripheral surface of the development sleeve 4*a* is conveyed toward the development station, its is regulated in thickness by the regulating blade 4*c* disposed in the radius direction of the development sleeve 4*a*. As a result, a thin layer of developer is formed on the peripheral surface of the development sleeve 4*a*. As this thin layer of developer is conveyed to a position in the development station, which corresponds to the development pole, the developer is made to crest like a wave by the magnetic force. The electrostatic latent image on the peripheral surface of the photoconductive drum 2 is developed by the toner within the crested portion of the thin layer of developer into a toner image. It should be noted here that in this embodiment, the electrostatic latent image is reversely developed.

As the development sleeve 4*a* is further rotated, the thin layer of developer on the peripheral surface of the development sleeve 4*a* passes the development station and enters the developer holding portion 4*h*, in which it is repelled by the repellent magnetic field of the conveyance pole, from the peripheral surface of the development sleeve 4*a*, and falls back into the developer holding portion 4*h*.

To the development sleeve 4*a*, DC and AC voltages are applied from unshown electrical power sources. More specifically, in this embodiment, a DC voltage of −500 V, and an AC voltage having a frequency of 2,000 Hz and a peak-to-peak voltage of 1,500 V, are applied to selectively develop the peripheral surface of the photoconductive drum 2; only the exposed portions of the peripheral surface of the photoconductive drum 2 are developed.

Generally speaking, in a two component magnetic brush based developing method, application of AC voltage improves the development efficiency, and therefore, improves image quality. However, it also brings forth such an adverse possibility that a foggy image will be produced. Thus, normally, difference in potential level is provided between the DC voltage applied to the development sleeve 4*a* and the electrical charge of the peripheral surface of the photoconductive drum 2 to prevent the formation of a foggy image. More concretely, the potential level of the bias voltage applied to the development sleeve 4*a* is set so that it falls between the surface potential levels of the exposed and unexposed portions of the photoconductive drum 2.

As the toner is consumed by development, the toner density of the developer reduces. Referring to FIG. 2, in this embodiment, a sensor 4*g* for detecting the toner density is disposed close to the peripheral surface of the stirring screw 4*e*B. As it is detected by the sensor 4*g* that the toner density of the developer has dropped below a predetermined level, a command for supplying toner into the developer holding portion 4*h* of the developing apparatus from the toner supply container 5 is issued. The toner density of the developer is kept at a predetermined level by this toner supplying process.

Toner Supply Container

Toner supply containers 5Y, 5M, 5C, and 5K are disposed in parallel to each other, above the process cartridges 1Y, 1M, 1C, and 1K, one for one. They are mounted from the front side of the image forming apparatus main assembly 100.

Figure 5:
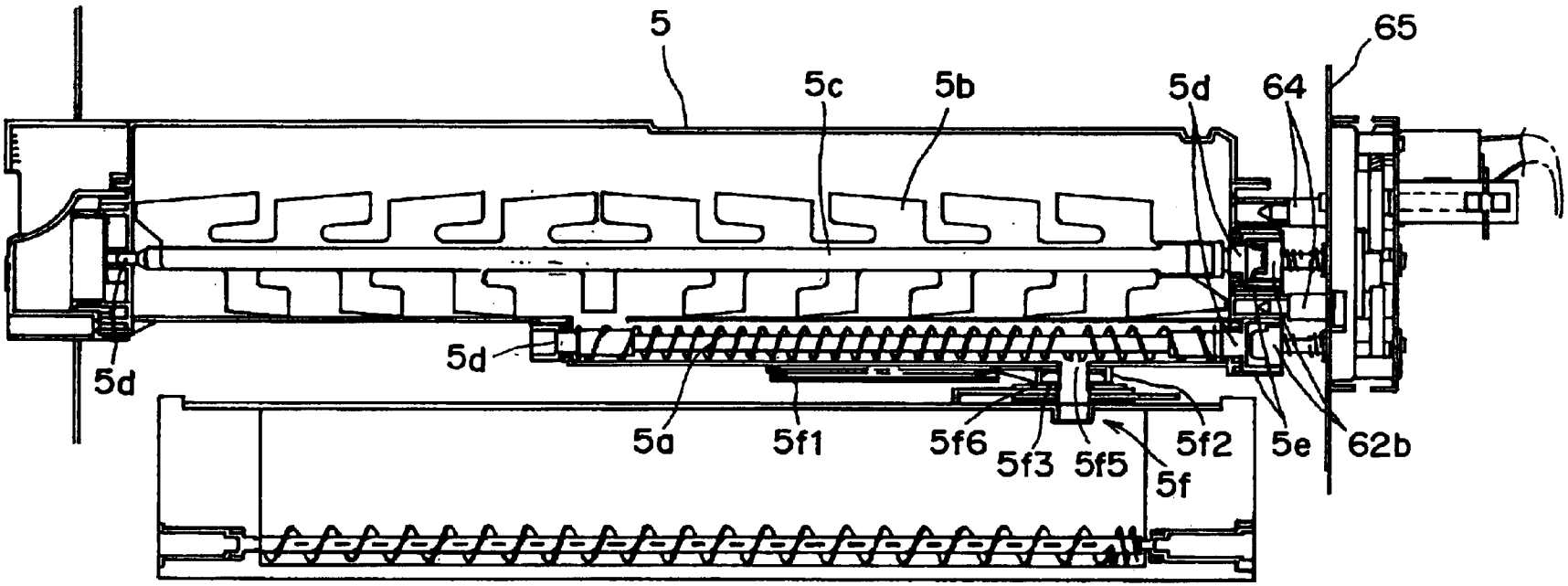
FIG. 5 is a vertical sectional view of the toner supply container and process cartridge in accordance with the present invention, at a vertical plane parallel to the lengthwise direction of the process cartridge.

Referring to FIG. 2, each toner supply container 5 comprises a shell 5*g* as a toner holding portion (developer holding portion), a stirring shaft 5*c*, a stirring plate 5*b*, and a screw 5*a*. Toner or a mixture of toner and magnetic carrier is stored in the shell 5*g*. The stirring plate 5*b* is fixed to the stirring shaft 5*c*. The stirring shaft 5*c*, stirring plate 5*b* and screw 5*a* are disposed within the shell 5*g*. The bottom wall of the toner supply container 5 is provided with a toner outlet hole 5*f* through which toner is discharged. Referring to FIG. 5, the screw 5*a* and stirring shaft 5*c* are rotationally supported by a pair of bearings 5*d*, by their lengthwise ends. The rearmost ends of the screw 5*a* and stirring shaft 5*c* are fitted with a driving coupling 5*e* (female type).

The driving coupling 5*e* (female type) is rotationally driven as it receives driving force from the driving coupling 62*b* (male type) on the apparatus main assembly 100 side. The peripheral portion of the screw 5*a* in terms of the radius direction of the screw 5*a* is in the form of a spiral rib, and has right and left sections, with respect to the axial line of the toner outlet hole 5*f*, which are opposite to each other in twist direction. The screw 5*a* is rotated in a predetermined direction by the rotation of the driving coupling 62*b* (male type). As the screw 5*a* rotates, toner is conveyed toward the toner outlet portion 5*f*, and is allowed to free fall through the toner outlet hole 5*f*5 of the toner outlet portion 5*f* to supply the process cartridge 1 with toner.

The peripheral edge of the stirring plate 5*b* in terms of the rotational radius direction is angled relative to the internal surface of the wall of the shell 5*g*, so that it makes contact with, and slides on, the internal surface of the wall of the shell 5*g* at an angle. More specifically, as the peripheral portion of the stirring plate 5*b* comes into contact with the wall of the shell 5*g*, it becomes spirally twisted. Therefore, as the stirring plate 5*b* is rotated, the peripheral portion of the stirring plate 5*b* contacts the toner at an angle, generating such force that moves the toner in the axial direction of the stirring shaft 5*c*. As a result, the toner is conveyed in the lengthwise direction of the process cartridge 1.

Incidentally, the toner supply container 5 in this embodiment is capable of supplying toner to not only a process cartridge which employs a two component developing method, but also a process cartridge which employs a single component developing method. It also is capable of supplying a development cartridge with toner. The choice of the powdery substance which is to be held in the toner supply container does not need to be limited to toner. Obviously, it may be so-called developer, that is, a mixture of toner and magnetic carrier.

Transferring Means

Referring to FIG. 1, an intermediary transfer unit 54, which is a transferring means, is a unit for transferring a toner image.

The intermediary transfer unit 54 is provided with an intermediary transfer belt 54*a*, which runs in the direction of an arrow mark. More specifically, the intermediary transfer belt 54*a* runs in the clockwise direction indicated by the arrow mark at a velocity approximately the same as the peripheral velocity of the photoconductive drum 2. This intermediary transfer belt 54*a* is an endless belt with a circumferential length of approximately 940 mm, and is suspended around three rollers: a driver roller 54*b*, a secondary transfer counter roller 54*g*, and a follower roller 54*c*.

Within the loop of intermediary transfer belt 54*a*, transfer charge rollers 54*f*Y, 54*f*M, 54*f*C, and 54*f*K are rotationally disposed, each being kept inward surface of the intermediary transfer belt 54*a*, at a position corresponding to the photoconductive drum 2 on the outward side of the transfer belt 54*a*, in the radius direction of the photoconductive drum 2 of the corresponding process cartridge.

The transfer charge rollers 54*f*Y, 54*f*M, 54*f*C, and 54*f*K receive electrical power from an unshown high voltage power source, and charge the intermediary transfer belt 54*a* to the polarity opposite to the toner polarity, from the inward side of the intermediary transfer belt loop, to sequentially transfer (primary transfer) the toner images on the photoconductive drums 2 onto the outward surface of the intermediary transfer belt 54*a*.

In the secondary transfer station, the secondary transfer roller 54*d* and secondary transfer counter roller 54*g* are disposed on the inward and outward sides of the intermediary transfer belt loop. When carrying out the second transfer process, the two rollers are pressed against each other in a manner to pinch the intermediary transfer belt 54*a* between them. The secondary transfer roller 54*d* is rotational, and also is movable in the vertical direction in FIG. 1. In order to prevent the secondary transfer roller 54*d* from disturbing the toner images on the intermediary transfer belt 54*a*, the secondary transfer roller 54*d* is kept separated from the intermediary transfer belt 54*a* until a multicolor image is completed, that is, until all the monochromatic toner images are transferred in layers onto the intermediary transfer belt 54*a*.

The intermediary transfer belt 54*a* and secondary transfer roller 54*d* are driven independently from each other. As the recording medium 52 enters the secondary transfer station, a predetermined bias is applied to the secondary transfer roller 54*d*. As a result, the multicolor toner image on the intermediary transfer belt 54*a* is transferred (secondary transfer) onto the recording medium 52.

During the above described secondary transfer process, the recording medium 52 is conveyed leftward in FIG. 1 at a predetermined velocity, while remaining pinched by the intermediary transfer belt 54*a* and secondary transfer roller 54*d*, to a fixing device 56 in which the next process is carried out.

At the most downstream end of the range in which the transfer process is carried out, a cleaning unit 55 is located, being enabled to be placed in contact with, or separated from, a predetermined point of the outward surface of the intermediary transfer belt 54*a* to remove the secondary transfer residual toner particles, or the toner particles remaining on the intermediary transfer belt 54*a* after the secondary transfer.

Referring to FIG. 1, a cleaning blade 55*a* for removing the secondary transfer residual toner particles is placed within a cleaning unit 55, which is rendered pivotal about an unshown pivot. The cleaning blade 55*a* is kept pressed upon the intermediary transfer belt 54*a*, being tilted against the moving direction of the intermediary transfer belt 54*a*. The secondary transfer residual toner particles are taken into the cleaning unit 55 and are conveyed by a conveying screw 55*b* to a container (unshown) for the secondary transfer residual toner particles, to be stored therein.

As for the material for the intermediary transfer belt 54*a*, polyimide resin may be used. The material selection is not limited to polyimide. For example, plastics such as polycarbonate resin, polyethylene-terephthalate resin, polyfluorovinylidene resin, polynaphthalate resin, polyether-ether-ketone resin, polyether-sulfone resin, or polyurethane resin, as well as fluorinated rubber or siliconized rubber, can also be used with preferable results, in addition to the polyimide resin.

Fixing Station

As described above, after being formed on the photoconductive drum 2 by the developing means, the toner image is transferred onto the recording medium 52 by way of the intermediary transfer belt 54*a*, and is thermally fixed to the recording medium 52 by the fixing device 56.

Referring to FIG. 1, the fixing device 56 has a fixing roller for applying heat to the recording medium 52, and a pressing roller 56*b* for pressing the recording medium 52 upon the fixing roller 56*a*. Both rollers are hollow, and contain a heater (unshown). They convey together the recording medium 52 as they are rotationally driven.

More specifically, heat and pressure are applied to the toner image and recording medium 52 as the recording medium 52 on which the toner image is held is conveyed by the fixing roller 56*a* and pressing roller 56*b*. As a result, the toner image is fixed to the recording medium 52. After the fixation of the toner image, the recording medium 52 is discharged by a discharge roller pair 53*h* and a discharge roller pair 53*j* from the apparatus main assembly 100, and is accumulated in a tray 57 located at the top of the apparatus main assembly 100.

Mounting of Process Cartridge and Toner Supply Container

Figure 3:
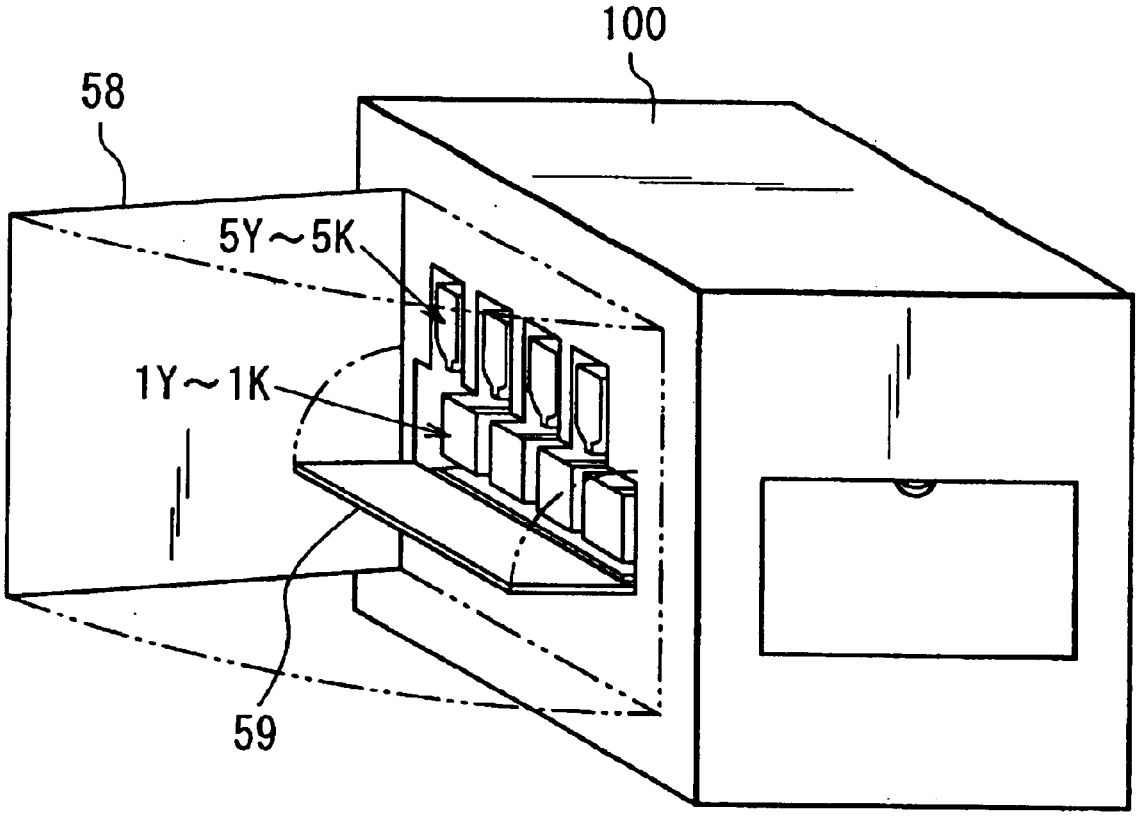
FIG. 3 is a perspective view of the main assembly of the image forming apparatus in accordance with the present invention, for showing the general appearance of the main assembly, with its front door open.

Next, referring to FIGS. 2–5, the steps through which the process cartridge 1 and toner supply container 5 are mounted into the apparatus main assembly 100 will be described. FIG. 3 is a rough, external perspective view of the image forming apparatus main assembly 100. As shown in FIG. 3, the image forming apparatus main assembly 100 is provided with a front door 58, which is located on the front side of the apparatus main assembly 100, and can be opened or closed by a user. As the front door 58 is pulled frontward, an entrance through which the process cartridges 1Y–1K, and toner supply containers 5Y–5K are inserted into the apparatus main assembly 100 is exposed.

The entrance through which each process cartridge 1 is inserted is provided with an aligning plate 59, which is rotationally supported. The process cartridge 1 is inserted or pulled out after this aligning plate is opened. Referring to FIG. 2, within the image forming apparatus main assembly 100, guide rails 60 for guiding the process cartridge 1 when mounting or dismounting the process cartridge 1, and guide rails 61 for guiding the toner supply container 5 when mounting or dismounting the toner supply container 5, are disposed.

The direction in which the process cartridge 1 or toner supply container 5 are mounted into the image forming apparatus main assembly 100 is parallel to the axial line of the photoconductive drum 2. Also, the direction in which the guide rails 60 and 61 are extended is parallel to the axial line of the photoconductive drum 2. When mounting the process cartridge 1 or toner supply container 5, it is slid into the apparatus main assembly 100, on the guide rails 60 or 61, respectively, from the front side of the apparatus main assembly 100.

Referring to FIG. 4, as the process cartridge 1 is inserted to the deepest end of the cartridge mounting space, the aligning shaft 66 of the apparatus main assembly 100 is inserted into the center hole 2*f* of the drum flange 2*b*. As a result, the position of the rotational axis of the deepest end (rear end) of the photoconductive drum 2 becomes fixed relative to the apparatus main assembly 100. At the same time, the driving force transmitting portion 2*g* of the drum flange 2*b* is connected with the driving coupling 62*a* (female type) of the apparatus main assembly 100, enabling the photoconductive drum 2 to be rotationally driven. The driving force transmitting portion 2*g* employed in this embodiment is in the form of a twisted triangular pillar. Thus, as it is rotated, not only does it transmit the driving force from the apparatus main assembly 100 side to the photoconductive drum 2, but also it generates such force that pulls the photoconductive drum 2 rearward of the apparatus main assembly 100.

Referring to FIG. 4, the rear plate 65 is provided with a supporting pin 63 for positioning the process cartridge 1; the position of the frame 1*a* of the process cartridge 1 relative to the apparatus main assembly 100 is fixed as the supporting pin 63 is inserted into the frame 1*a* of the process cartridge 1.

Also referring to FIG. 4, the apparatus main assembly 100 is provided with a rotatable aligning plate 59, which is located on the front side (left side in FIG. 4). Into the hole of this aligning plate 59, the bearing case 2*c* of the process cartridge 1 is inserted, so that the process cartridge 1 is supported by the apparatus main assembly 100 while being accurately positioned relative to the apparatus main assembly 100. Through the above described insertion sequence, the photoconductive drum 2 and process cartridge 1 are accurately positioned relative to the apparatus main assembly 100.

Referring to FIG. 5, as the toner supply container 5 is inserted to the deepest end of the toner supply container mounting space in the same manner as the process cartridge 1 is inserted to the deepest end of the process cartridge mounting space, the position of the toner supply container 5 is fixed relative to the apparatus main assembly 100 by a supporting pin 64 which projects from the rear plate 65. At the same time, the driving coupling 5*e* (female type) becomes connected with the driving coupling 62*b* (male type), enabling the screws 5*a* and stirring shaft 5*c* to be rotationally driven.

On the other hand, in order to pull the process cartridge 1 or toner supply container 5 out of the apparatus main assembly 100, the above described mounting steps have only to be carried out in the reverse order. In this embodiment, the process cartridges 1 and toner supply containers 5 are enabled to be mounted into, or dismounted from, the apparatus main assembly 100 in any order. In other words, the process cartridge 1 can be mounted into the apparatus main assembly 100 either before or after the toner supply container 5 is mounted into the apparatus main assembly 100. Further, the process cartridge 1 can be pulled out of the apparatus main assembly 100 either before or after the toner supply container 5 is pulled out of the apparatus main assembly 100.

Embodiments

Next, referring to FIGS. 6–17, the preferred embodiments of the present invention will be described.

Figure 6:
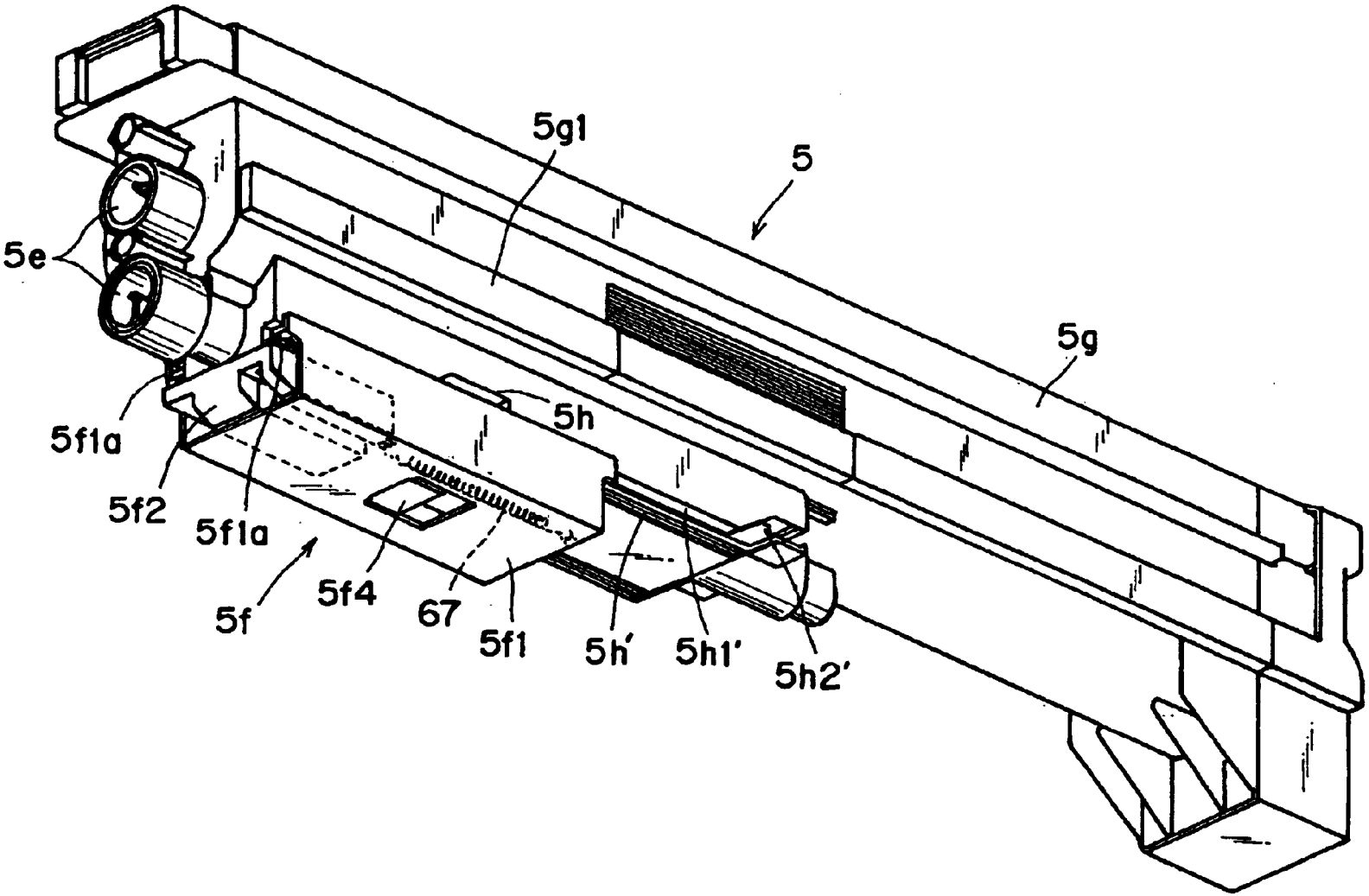
FIG. 6 is a perspective view of the toner supply container in accordance with the present invention, for showing the toner supply container, with its toner outlet cover closed.

FIG. 6 is a perspective view of the toner supply container 5 in accordance with the present invention, as seen from diagonally below the bottom, rear, left corner of the container. As shown in the drawing, each of the two lateral walls of the shell 5*g*, or each of the two lateral walls of the toner holding portion, of the toner supply container 5, is provided with a guiding portion 5*g*1 for guiding the toner supply container 5 when the toner supply container 5 is inserted into the apparatus main assembly 100. The guiding portion 5*g*1 slightly protrudes from the lateral wall outward of the shell 5*g*, and extends straight along the lateral wall in the lengthwise direction of the shell 5*g*. The downwardly facing surface of the guiding portion 5*g*1 is flat and smooth. As the toner supply container 5 is mounted into the apparatus main assembly 100, this downwardly facing surface of the guiding portion 5*g*1 contacts the upwardly facing surface of the guide rail 61 on the apparatus main assembly 100 side (FIG. 2), in a manner to ride thereon, to accurately position the toner supply container 5 relative to the apparatus main assembly 100 in terms of the vertical direction.

Figure 14:
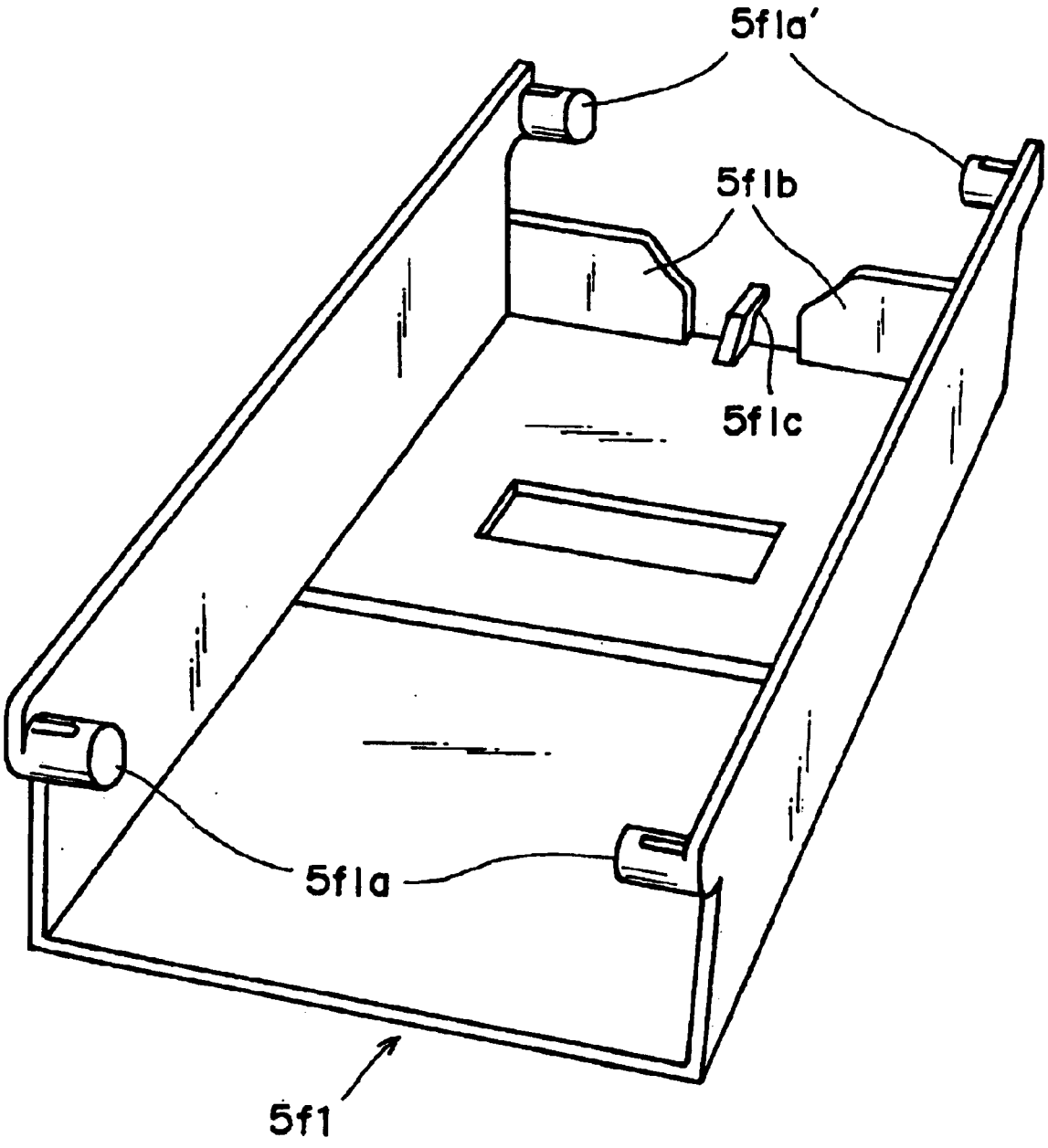
FIG. 14 is a perspective view of the toner outlet hole cover of the toner supply container in accordance with the present invention.

The toner outlet portion 5*f* of the toner supply container 5, which is located at the bottom of the toner supply container 5, is provided with a toner outlet cover 5*f*1 for covering the toner outlet portion 5*f*. The toner outlet cover 5*f*1 is enabled to be moved in the lengthwise direction of the toner supply container 5. Referring to FIG. 14, the toner outlet cover 5*f*1 is open upward and has a U-shaped cross section. It has four engagement projections: a pair of engagement projections 5*f*1*a* which perpendicularly project inward of the toner outlet cover 5*f*1 from the front ends of the inward surface of the lateral walls, or the walls correspondent to the upright portions of the U-shaped cross section, of the toner outlet cover 5*f*1, and a pair of engagement portions 5*f*1' which perpendicularly project inward of the toner outlet cover 5*f*1 from the rear end of the inward surface of the lateral walls. The toner outlet cover 5*f*1 is also provided with a pair of rear plates 5*f*1*b*, which are located one for one in the left and right bottom corners of the toner outlet cover 5*f*1, with the presence of a predetermined gap between the two plates. The toner outlet cover 5*f*1 is also provided with a hook 5*f*1*c* on which one end of a tension spring 67 is hung. It is attached to the bottom wall of the toner outlet cover 5*f*1, being positioned in the center of the gap between the pair of rear plates 5*f*1*b*.

Figure 15:
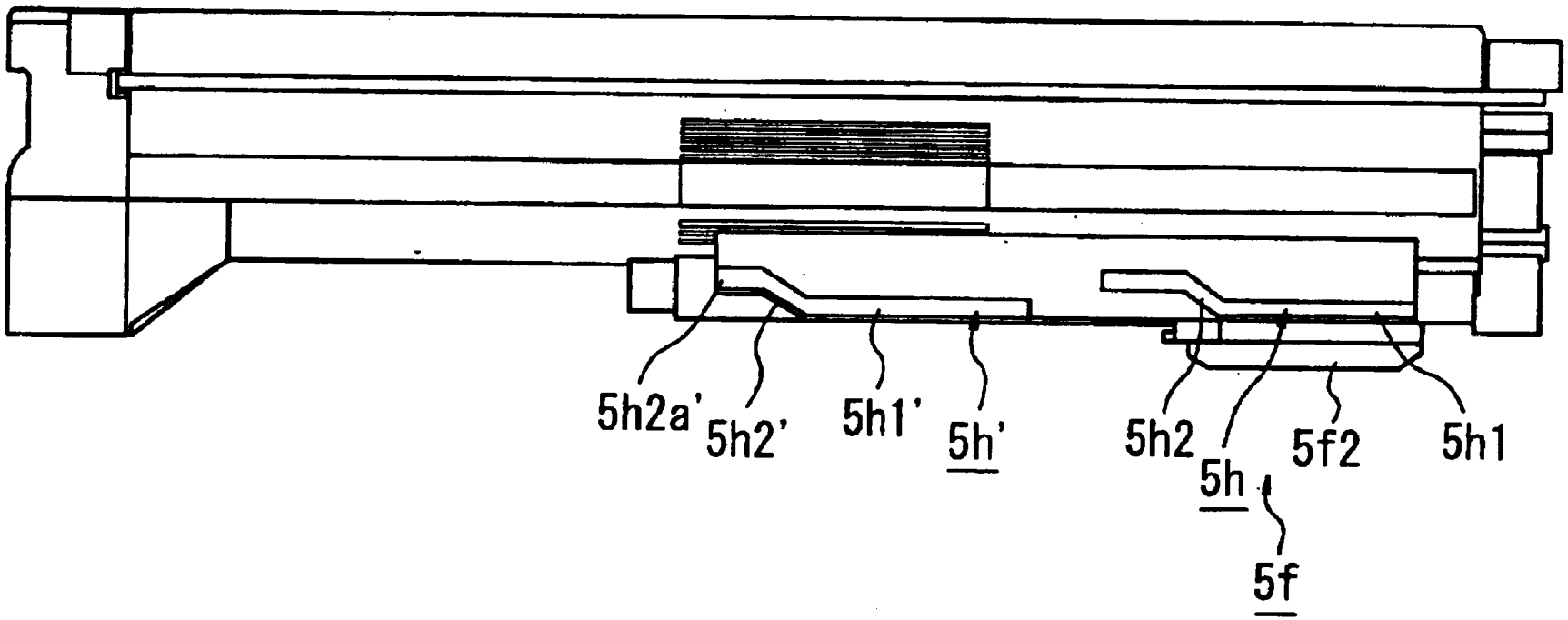
FIG. 15 is a side view of the toner supply container in accordance with the present invention, as seen from the direction perpendicular to the lengthwise direction of the process cartridge, in which the toner outlet hole cover has been removed.

FIG. 15 is a side view of the toner supply container 5. In the drawing, the leading end of the toner supply container in terms of the direction in which the toner supply container 5 is inserted is on the right side. The left and right side walls of the toner supply container 5 are provided with grooves 5*h* and 5*h*', into which the engagement portions 5*f*1*a* and 5*fa*' of the toner outlet cover 5*f*1 engage. Each of grooves 5*h* and 5*h*' has a first guiding portion 5*h*1 (5*h*1') which extends straight rearward in the lengthwise direction of the toner supply containers 5 from the front end of the cover, and a second guiding portion 5*h*2 (5*h*2') which extends straight in the diagonally upward, toward the rear, from the rear end of the first guiding portion 5*h*1 (5*h*1'). The right end of the groove 5*h*', that is, the right end of the left groove in FIG. 15, is a dead end, and the left end of the groove 5*h*' is provided with a projection 5*h*2*a*', which projects upward.

The outwardly protruding engagement portions 5*f*1*a* of the toner outlet cover 5*f*1 engage into the grooves 5*h* in the lateral walls of the toner supply container 5, and the engagement portions 5*f*1*a*' engage into the groove 5*h*' so that the toner outlet cover 5*f*1 is enabled to move following the grooves 5*h* and 5*h*'.

Referring to 8(*a*), before the mounting of the toner supply container 5 into the apparatus main assembly 100, the toner outlet cover 5*f*1 is at a first position where it covers the toner outlet portion 5*f*. In this state, the engagement portion 5*f*1*a*' of the toner outlet cover 5*f*1 is in contact with the right end of the groove 5*h*', preventing the toner outlet cover 5*f*1 from moving further rightward.

Figure 7:
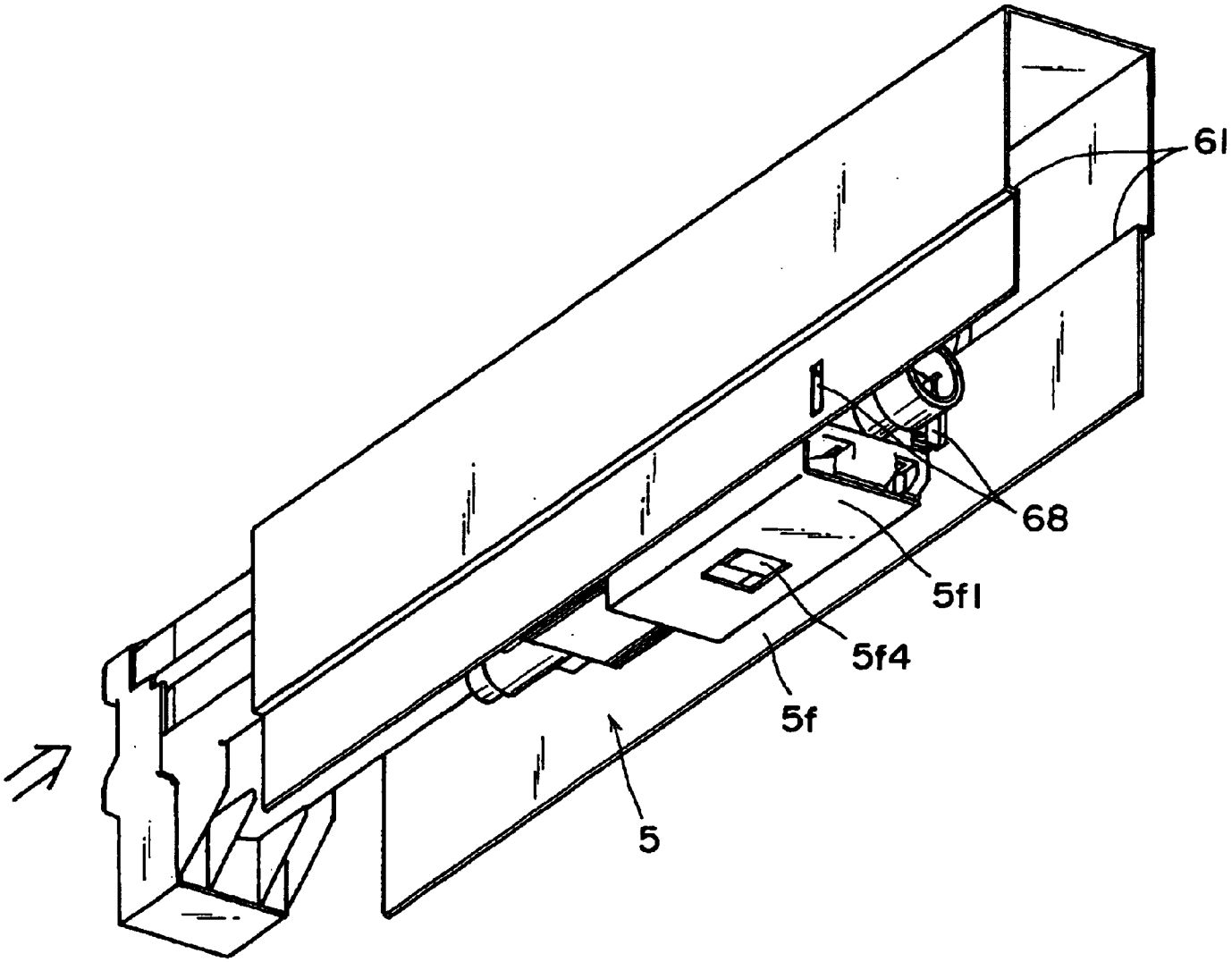
FIG. 7 is a perspective view of the toner supply container in accordance with the present invention, which is being inserted into the image forming apparatus main assembly.
Figure 8:
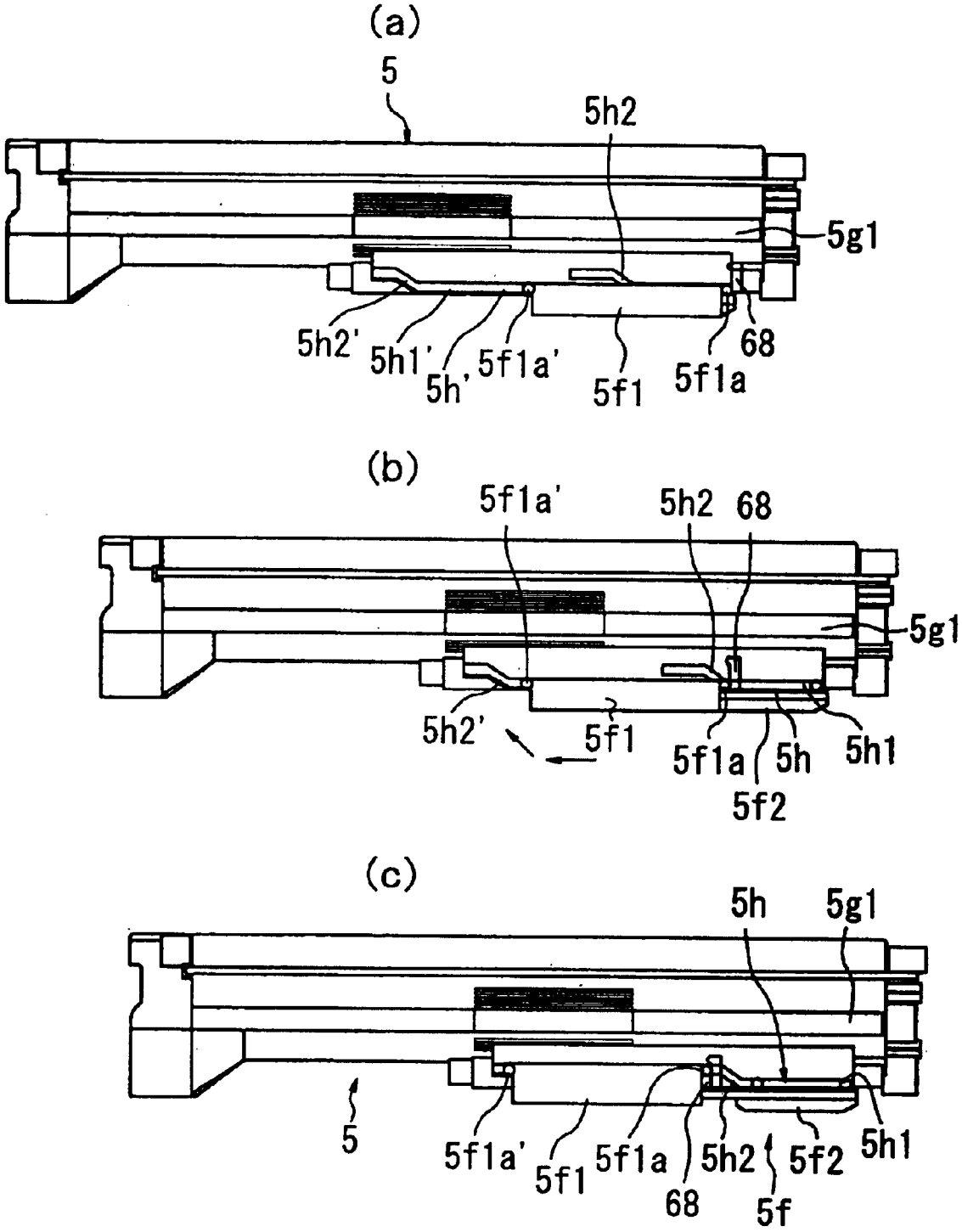
FIGS. 8(*a*), 8(*b*), and 8(*c*) are side views of the toner supply container in accordance with the present invention, for showing the movement of the toner outlet cover of the container, as seen from the direction perpendicular to the lengthwise direction of the process cartridge.

When the toner supply container 5 is inserted into the apparatus main assembly 100, the guiding portions 5*g*1 of the toner supply container 5 contact the corresponding guiding rails 61 on the apparatus main assembly 100 side, and slide thereon, as described above. During this sliding movement of the toner supply container 5, the leading end of the toner outlet cover 5*f*1 in terms of the toner supply container insertion direction comes into contact with a projection 68 of the apparatus main assembly 100, as shown in FIG. 7. Thus, as the toner supply containers 5 is further inserted, the toner outlet cover 5*f*1 is moved toward the trailing end of the toner supply container 5 in relative terms, as shown in FIG. 8(*b*), since the toner outlet cover 5*f*1, which has come into contact with the projection 68, is prevented from moving further rightward, that is, kept stationary, and therefore causing the tension spring 67 to stretch. In relative terms, the toner outlet cover 5*f*1 moves following the grooves 5*h* and 5*h*', until it reaches a second position where it exposes a shutter holding member 5*f*2, through which the internal spaces of the process cartridge 1 and toner supply container 5 become connected (FIG. 8(*c*)).

Referring to FIG. 8, the above described movement of the toner outlet cover 5*f*1 will be described in more detail. FIG. 8 is a side view of the toner supply container 5, as seen from the direction perpendicular to the lengthwise walls of the toner supply container 5, for showing the steps through which the toner supply container 5 is inserted into the apparatus main assembly 100. The inserting steps occur in the order of FIGS. 8(*a*)–8(*c*). As described before, after coming into contact with the projection 68 of the apparatus main assembly 100, the toner outlet cover 5*f*1 is moved following the first guiding portion 5*h*1 (5*h*1') of the groove 5*h* (5*h*') in the toner supply container insertion direction, which is the approximately horizontal direction. Then, it is moved upward, which is the direction to move the toner outlet cover 5*f*1 away from the process cartridge 1, that is, the developing means in this embodiment, following the second guiding portion 5*h*2 (5*h*2') of the grooves 5*h* (5*h*'). As a result, the shutter holding member 5*f*2 is exposed.

Obviously, during this upward movement of the toner outlet cover 5*f*1, the toner outlet cover 5*f*1 does not move approximately in the horizontal direction relative to the apparatus main assembly 100, but is simply guided upward, that is, retracted upward, by the second guiding portions 5*h*2 (5*h*2') of the grooves. Further, since the distance between the engagement portion 5*f*1*a* and 5*f*1*a*' of each lateral wall of the toner outlet cover 5*f*1 is equal to the distance between the two second guiding portions 5*h*2 and 5*h*2' of the grooves of the corresponding lateral wall of the toner supply container 5, the toner outlet cover 5*f*1 is moved upward to the second position while remaining parallel to the bottom surface of the toner supply container 5 as it was when it was at the first position.

Further, there is the projection 5*h*2*a*' at the left end of the groove 5*h*' as shown in FIG. 15. Therefore, as the toner outlet cover 5*f*1 is moved, the engagement portion 5*fa*1' comes into contact with the projection 5*h*2*a*', stopping the toner outlet cover 5*f*1 from being moved further.

With the provision of the above described structural arrangement, the toner outlet cover 5*f*1 is retracted in the direction to separate (move upward in FIG. 8) from the process cartridge 1 as a developing means in this embodiment. Therefore, the space into which the toner outlet cover 5*f*1 is retracted as the toner supply container is inserted into the apparatus main assembly 100 does not affect the space in which the process cartridge 1 is mounted. In other words, the internal space of the apparatus main assembly 100 is better utilized.

Further, in this embodiment, the process cartridges 1 and toner supply containers 5 can be inserted into, or pulled out of, the apparatus main assembly 100 in any order. Therefore, it is probable that the toner supply container 5 has been mounted in the apparatus main assembly 100 ahead of the process cartridge 1. In such a case, simply retracting the toner outlet cover 5f1 from the first position in the horizontal direction allows the toner outlet cover 5f1 to come into contact with the toner inlet portion 1*b* on the process cartridge 1 side, as the process cartridge 1 is inserted. This is a problem. In order to deal with this problem by the structural modification on the process cartridge 1 side, it is necessary to enable the toner inlet portion 1*b* of the process cartridge 1 to retract. Such a modification is liable to extremely complicate the structure of the toner inlet portion 1*b*. However, according to an aspect of the present invention regarding the structure of the toner supply container 5, the toner outlet cover 5f1 is retracted in the direction to move away from the process cartridge 1. Therefore, the above described problem does not occur.

As the toner supply container 5 is pulled out of the apparatus main assembly 100, the toner outlet cover 5f1 is moved by the resiliency of the tension spring 67 in the direction opposite to the direction in which it is moved when the toner supply container is mounted, and returns to the original position, or the first position. Incidentally, the toner supply container 5 is provided with a toner outlet hole shutter 5f3, which is located so that when the toner supply container 5 is mounted into the apparatus main assembly 100, the toner outlet cover 5f1 is opened before the toner outlet hole shutter 5f3, which will be described later, is moved from the closed position to the open position, whereas when the toner supply container 5 is removed from the apparatus main assembly 100, the toner outlet cover 5f1 closes after the toner outlet hole shutter 5f3 moves from the open position to the closed position.

Next, the structural arrangement in the toner supply container 5 in accordance with the present invention, for preventing toner from leaking from the toner supply container 5, will be described. Referring to FIGS. 2 and 5, the bottom wall of the toner supply container 5 is provided with the toner outlet portion 5*f* through which the toner within the toner supply container 5 is discharged into the process cartridge 1. The toner outlet portion 5*f* has a first hole 5f5, which is located in the approximate center of the toner outlet portion 5*f*. The toner outlet portion 5*f* is provided with a sealing member 5f6, which surrounds the first hole 5f5, and is pasted to the bottom wall of the toner supply container 5. In this embodiment, the toner outlet portion 5*f* is disposed toward one of the lengthwise ends of the toner supply container, on the side from which driving force is transmitted to the screw 5*a*; it is located toward the leading end (right side in FIG. 5) in terms of the direction in which the toner supply container 5 is inserted.

Figure 16:
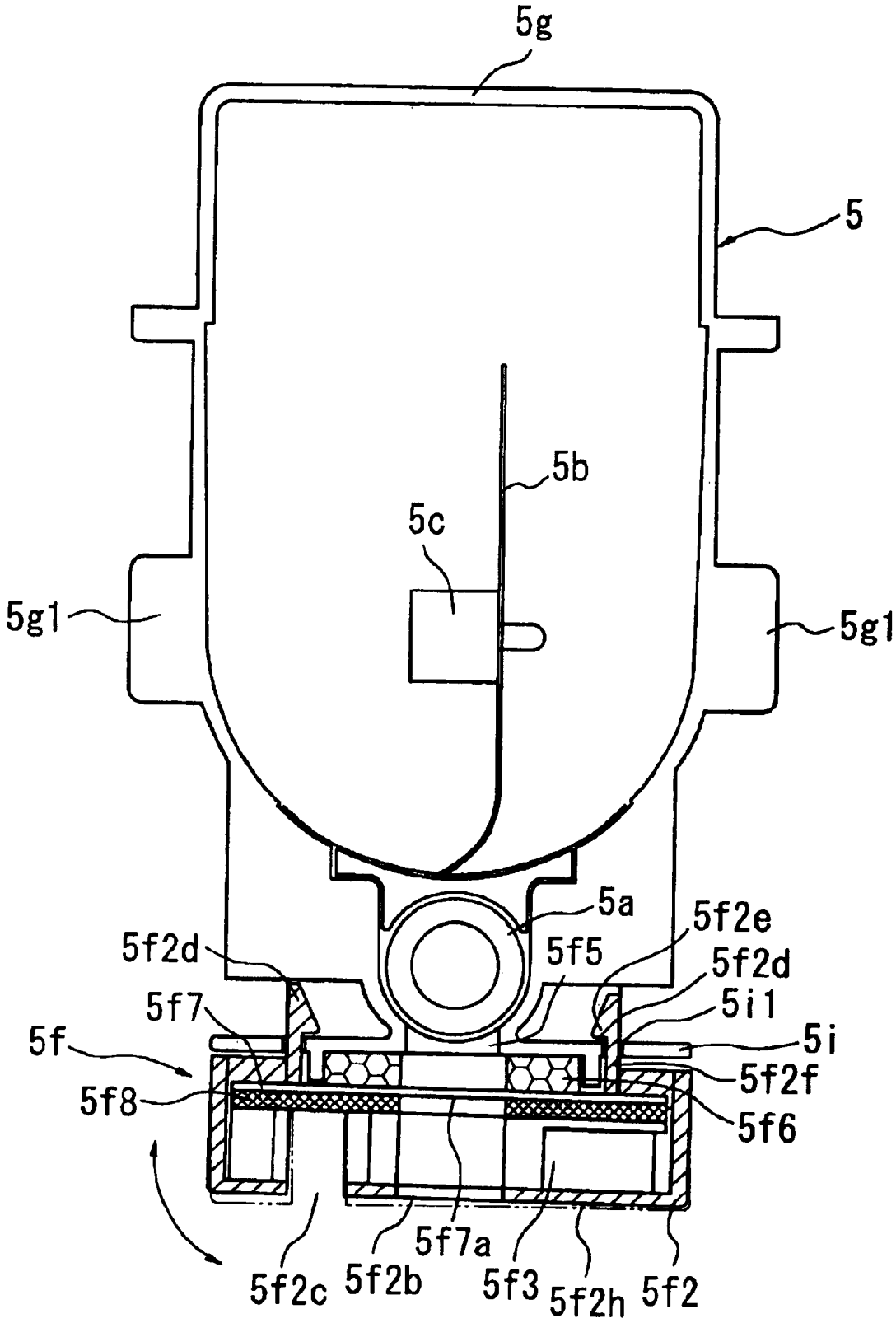
FIG. 16 is a vertical sectional view of the toner outlet portion of the toner supply container in accordance with the present invention.

At this time, referring to FIG. 16, the structures of the first hole 5f5 and its adjacencies will be described in detail. FIG. 16 is a vertical sectional view of the toner supply container 5 at a vertical plane which includes the axial line of the first hole 5f5 and is perpendicular to the lengthwise direction of the toner supply container 5. The first hole 5f5, which is a through hole, is located below the screw 5*a*, and the first sealing member 5f6 is located below the first hole 5f5. The first sealing member 5f6 is provided to prevent toner from leaking from the edge of the first hole 5f5. It is an elastic member with a predetermined thickness, and its opening is the same in shape as that of the first hole 5f5. The first sealing member 5f6 is pasted to the peripheries of the bottom opening of the first hole 5f6, by its upwardly facing surface, with its opening in alignment with the first hole 5f5. In this embodiment, foamed urethane is used as the material for the first sealing member 5f6. However, the material choice for the first sealing member 5f6 does not need to be limited to foamed urethane; any elastic material may be used.

Below the first sealing member 5f6, a sealing plate 5f7 is located. The sealing plate 5f7 is pasted to the downwardly facing surface of the first sealing member 5f6, by its upwardly facing surface. Since the sealing plate 5f7 is supported by the first sealing member 5f6, it is allowed to move vertically or tilt within a range afforded by the elasticity of the first sealing member 5f6. The sealing plate 5f7 is provided with a third hole 5f7*a*, which is a through hole, and is alignment with the first hole 5f5. In other words, the toner outlet portion 5*f* is contrived so that the toner falls through the first hole 5f5, hole of the first sealing member 5f6, and third hole 5f7*a* of the sealing plate 5f7 in this order.

The bottom portion of the toner supply container 5 is provided with the toner outlet hole shutter 5f3 for opening or closing the first hole 5f5, and the toner outlet hole shutter holding member 5f2 which prevents the toner outlet hole shutter 5f3 from falling off, as well as connecting between the first hole 5f5 and the toner inlet 1*b* of the process cartridge 1. Referring to FIG. 16, the toner outlet hole shutter 5f3 is located below the sealing plate 5f7, and a second sealing member 5f8 is sandwiched between the toner outlet hole shutter 5f3 and sealing plate 5f7. The second sealing member 5f8 is for preventing toner from leaking from the peripheries of the opening of a second hole 5f3*b*, with which the toner outlet hole shutter 5f3 is provided, and which will be described later. It is an elastic member, and is disposed so that its hole aligns with the second hole 5f3*b*. The second sealing member 5f8 is pasted to the toner outlet hole shutter 5f3 by its downwardly facing surface, but its upwardly facing surface is not fixed to the downwardly facing surface of the sealing plate 5f7, being allowed to slide against the sealing plate 5f7. As for the material for the second sealing member 5f8, such substances that have elasticity and are low in the friction against the sealing plate 5f7, are preferable. More specifically, a sheet of foamed urethane, or a sheet of foamed urethane to which a low friction sheet has been pasted, or the like, may be used.

Figure 9:
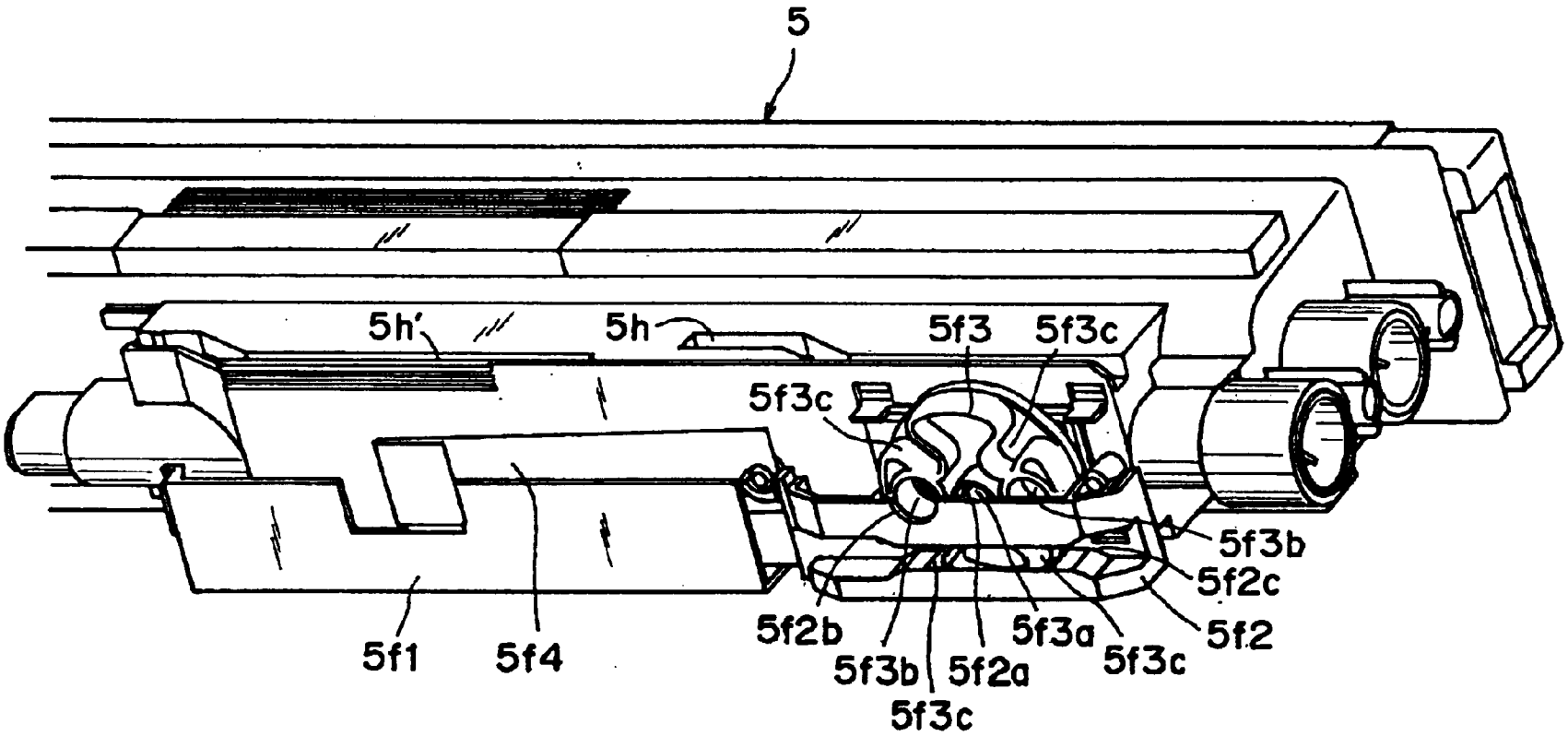
FIG. 9 is an enlarged perspective view of the toner outlet portion of the toner supply container in accordance with the present invention.

FIG. 9 is an enlarged perspective view of the toner outlet cover and toner outlet hole shutter portions of the toner supply container 5, as seen diagonally below the bottom, rear, right corner of the toner supply container 5. In the drawing, the halves of the toner outlet cover 5f1 and shutter holding member 5f2, with respect to their center lines parallel to the lengthwise direction of the toner supply container 5, have been removed for visual confirmation. As shown in the drawing, the toner outlet hole shutter 5f3 rotates about a rotational axis 5f3*a*. It has two second holes 5f3*b* symmetrically located with respect to the rotational axis 5f3*a*, and four slits 5f3*c*, which are engagement portions for rotating the shutter. The positions of the four slits 5f3*c* are offset from the adjacent second holes 5f3*b* by 45°.

Figure 17:
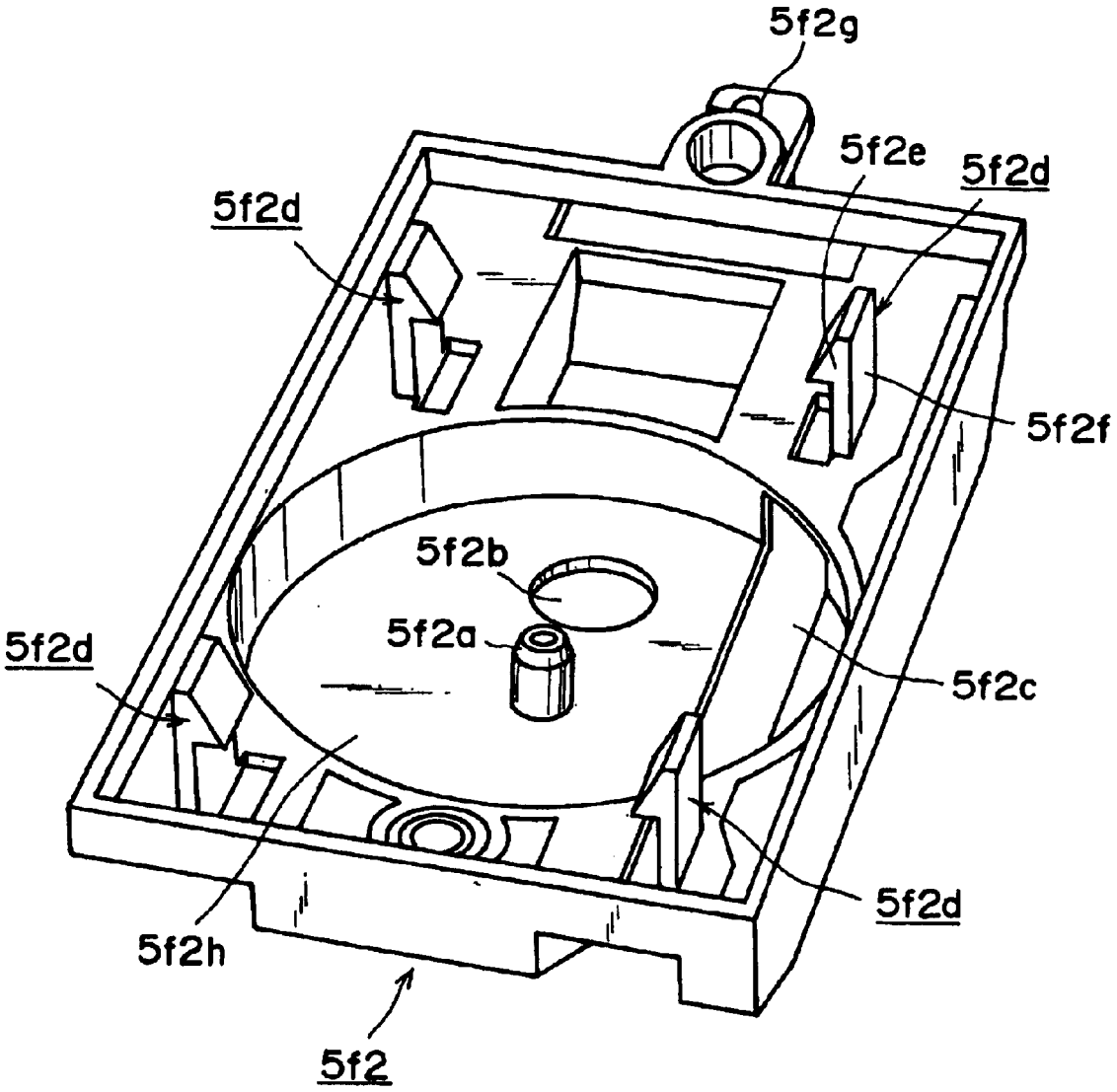
FIG. 17 is a perspective view of the shutter holding portion of the toner supply container in accordance with the present invention.

Next, referring to FIG. 17, the shutter holding member 5f2 will be described. FIG. 17 is a perspective view of the shutter holding member 5f2, which has been removed from the toner supply container 5. The shutter holding member 5f2 is provided with a pin 5f2*a*, which constitutes the rotational axis for rotationally supporting toner outlet hole shutter 5f3, a fourth hole 5f2*b*, that is, a through hole through which toner is supplied, and a slit 5f2*c* which extends approximately straight in the lengthwise direction of the shutter holding member 5f2. The pin 5f2*a* perpendicularly projects from the upwardly facing surface of the bottom wall 5f2*h* of the shutter holding member 5f2. The pin 5f2*a* rotationally supports the toner outlet hole shutter 5f3 by being fitted in the center hole 5f3*a* of the toner outlet hole shutter 5f3. The four corners of the shutter holding member 5f2 are provided with a pawl 5f2*d*, which projects upward. As the shutter holding member 5f2 is attached to the bottom plate 5*i* of the toner supply container 5 as shown in FIG. 16, each pawl 5f2*d* fits into the corresponding hole 5*i*1 in the bottom plate 5*i*, and the claw 5f2*e* of the pawl 5f2*d*, which projects inward of the pawl 5f2, catches the bottom plate 5*i*, locking the shutter holding member 5f2 to the bottom plate 5*i* in a manner of being hung from the bottom plate 5*i*.

The arm portion 5f2*f* of the pawl 5f2*d* is rendered long enough for the shutter holding member 5f2 to be kept pressed downward by the resiliency of the first sealing member 5f6. Further, the pawl 5f2*d* is fitted in the hole 5*i*1 of the bottom plate 5*i* with the presence of a certain amount of play so that the shutter holding member 5f2 is allowed to move left or right, or tilt, relative to the bottom plate 5*i*. In other words, the shutter holding member 5f2 is attached to the bottom plate 5*i* of the toner supply container 5 with the presence of a certain amount of play so that the shutter holding member 5f2 is allowed to move vertically, left or right, or tilt, relative to the bottom plate 5*i*. Consequently, the shutter holding member 5f2 is allowed to slightly move vertically, left, or right, or tilt, relative to the shell 5*g* (FIG. 16). This tilting of the shutter holding member 5f2 is not limited to the left or right direction indicated by an arrow mark in FIG. 16; it is allowed to tilt in the direction perpendicular to FIG. 16. Further, the shutter holding member 5f2, toner outlet hole shutter 5f3, and sealing plate 5f7 are enabled to slightly move together vertically, left or right, or slightly tilt, relative to the shell 5*g*.

The toner supply container 5 is provided with the toner outlet cover 5f1, which is attached to the toner supply container 5 in such a manner that the toner outlet cover 5f1 is enabled to cover the above described shutter holding member 5f2, to be moved by the grooves 5*h* and 5*h*' of the toner supply container 5 toward the trailing end of the toner supply container 5 in terms of the toner supply container insertion direction, and to be retracted upward also by the grooves 5*h* and 5*h*'. Prior to the mounting of the toner supply container 5 into the apparatus main assembly 100, the second hole 5f3*b* of the toner outlet hole shutter 5f3 is at the first position, which is 90° apart in terms of the rotational phase of the toner outlet hole shutter 5f3 from the position of the first hole 5f5, and first hole 5f5 is closed by the toner outlet hole shutter 5f3. The shutter holding member 5f2 is provided with a hook 5f2*g* on which one of the tension spring 67 is hung, and the toner outlet cover 5f1 is kept under the pressure generated by the tension spring 67 in the direction to keep the shutter holding member 5f2 at the first position where the toner outlet cover 5f1 covers the shutter holding member 5f2 (FIG. 6).

Next, the procedure for inserting or extracting the toner supply container 5 into or from the apparatus main assembly 100 will be described.

As described using FIG. 8, the apparatus main assembly 100 side is provided with the projection 68, which stands in the passage of the toner supply container 5 into the apparatus main assembly 100. As the toner supply container 5 is insert into the apparatus main assembly 100, the leading end of the toner outlet cover 5f1 comes into contact with this projection 68. Then, as the toner supply container 5 is further inserted against the resiliency of the tension spring 67, the toner outlet cover 5f1 is retracted upward by the grooves 5*h* and 5*h*' while appearing as if moving toward the trailing end of the toner supply container 5 in terms of the toner supply container insertion direction.

Figure 10:
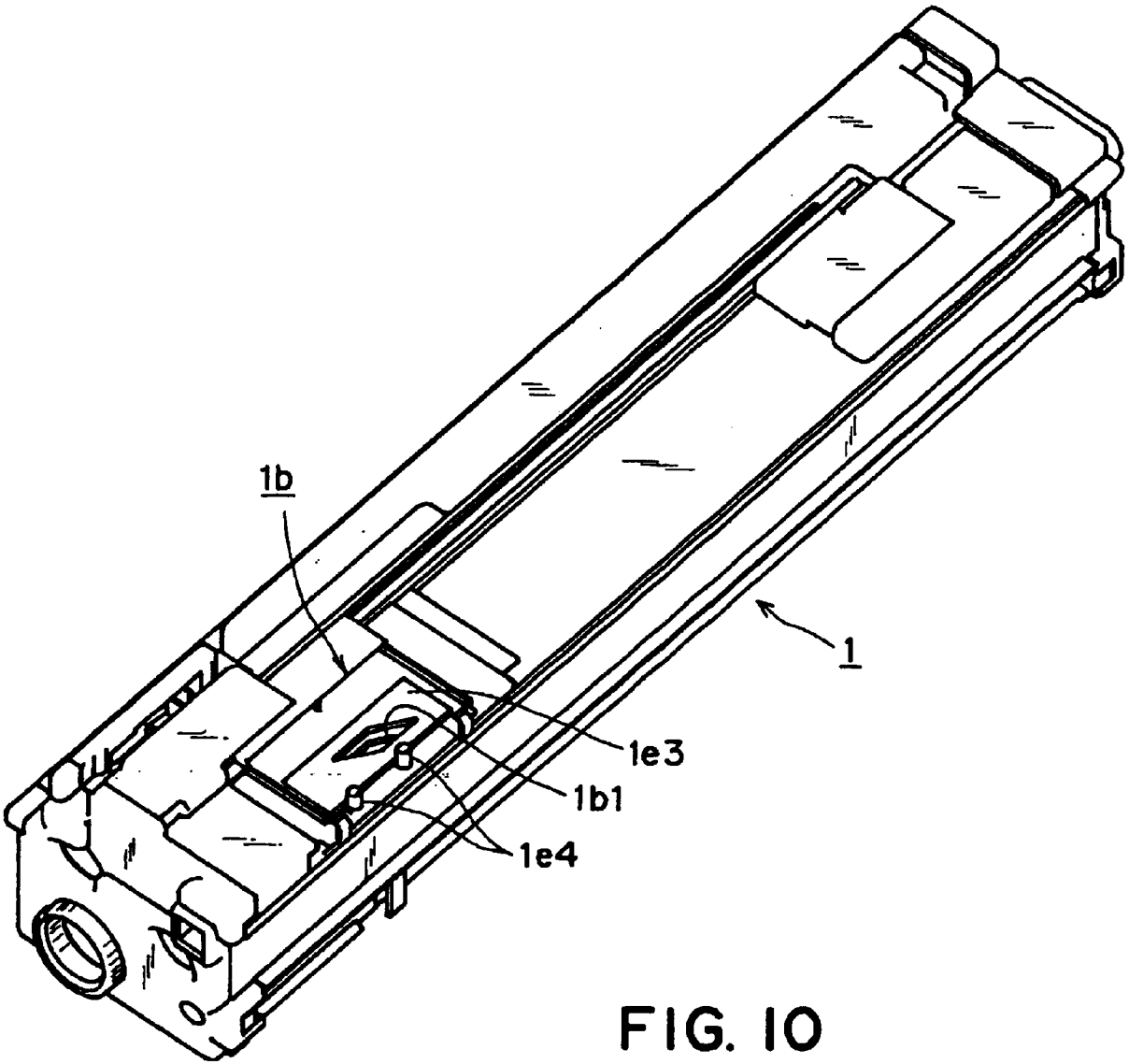
FIG. 10 is a perspective view of the process cartridge in accordance with the present invention.

FIG. 10 is a perspective view of the process cartridge 1 in this embodiment, as seen from diagonally above the top, front, right corner. The toner inlet 1*b* of the process cartridge 1, which is the portion of the process cartridge 1, and through which toner is supplied to the process cartridge 1 from the toner supply container 5, is provided with a toner inlet hole 1*b*1. The toner inlet hole 1*b*1 is a through hole through which the toner from the toner supply container 5 falls into the process cartridge 1. The outward opening of the toner inlet hole 1*b*1 is surrounded with a sealing member 1*e*3, which is formed of elastic material and has a hole which is the same in shape as the opening of the toner inlet hole 5*b*1. The sealing member 1*e*3 prevents toner from leaking from the peripheries of the toner inlet hole 1*b*1. The process cartridge 1 is provided with two guide pins 1*e*4 for rotating the toner outlet hole shutter 5f3 of the toner supply container 5. The two guide pins 1*e*4 are located next to the sealing member 1*e*3. The toner inlet hole 1*b*1 is a through hole with an approximately parallelepiped cross section. One pair of opposing edges are parallel to the lengthwise direction of the process cartridge 1, and the sealing member 1*e*3 is placed in a manner to cover the peripheries of the toner inlet hole 1*b*1. The sealing member 1*e*3 is for keeping sealed between the toner supply container 5 and process cartridge 1 by coming into, and remaining in, contact with the shutter holding member 5f2 of the toner supply containers 5. Not only is the sealing member 1*e*3 desired to have elasticity, but also it is desired to be high in wiping efficiency in terms of toner removal, and low in friction. As for the material for the sealing member 1*e*3, Teflon felt, Teflon pile, foamed urethane, electrostatically planted fibers, or the like, can be used, for example.

Figure 11:
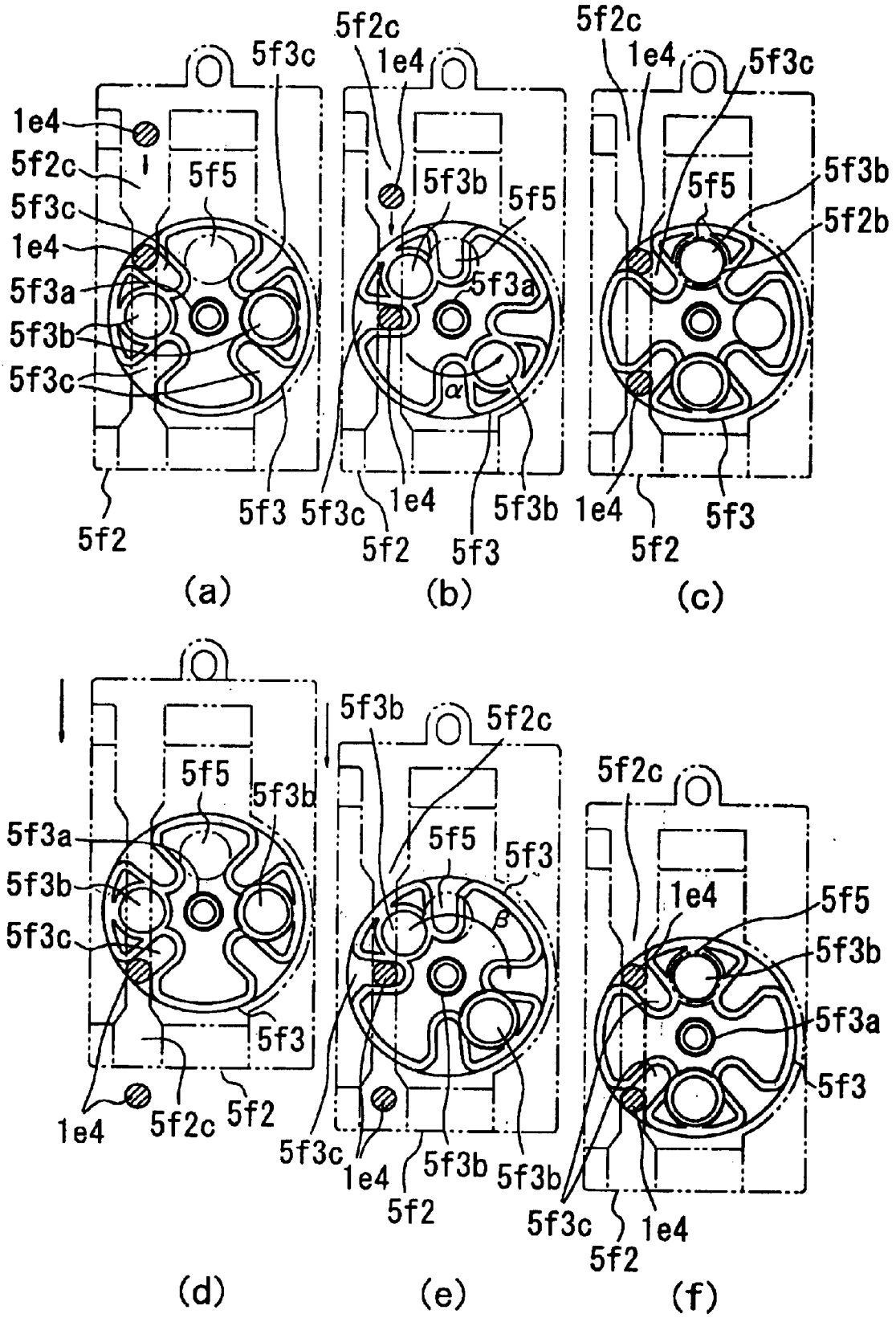
FIGS. 11(*a*)–11(*f*) are rough drawings of the toner outlet hole shutter of the toner supply container in accordance with the present invention, for showing the movement of the shutter.

FIG. 11 is a drawing for showing the operational stages of the toner outlet hole shutter 5f3. FIGS. 11(*a*)–11(*c*) show the stages through which the process cartridge 1 is inserted into the apparatus main assembly 100 in which the toner supply container 5 has already been mounted, whereas FIGS. 11(*d*)–11(*f*) show the stages through which the toner supply container 5 is inserted into the apparatus main assembly 100 in which the process cartridge 1 has already been mounted.

Referring to FIGS. 11(*d*)–11(*f*), when the process cartridge 1 has already been mounted in the apparatus main assembly 100, the two guide pins 1*e*4 are not movable. As the toner supply container 5 is inserted in the direction indicated by an arrow mark in the drawing, the guide pin 1*e*4 of the process cartridge 1 on the front side engages into the slit 5f3*c* of the toner outlet hole shutter 5f3 (FIG. 11(*d*)). In this state, the first hole 5f5 is closed by the toner outlet hole shutter 5f3, because the position of the second hole 5f3*b* is 90° apart from the position of the first hole 5f5 in terms of the rotational phase of the toner outlet hole shutter 5f3.

As the toner supply container 5 is further inserted, the toner outlet hole shutter 5f3 begins to be rotated in the direction indicated by an arrow mark about the rotational axis 5f3*a* (FIG. 11(*e*)). By the time the toner supply container 5 is inserted to its final mounting position, the toner outlet hole shutter 5f3 is rotated to the position shown in FIG. 11(*f*), at which the first hole 5f5 of the toner supply container 5 aligns with the second hole 5f3*b* of the toner outlet hole shutter 5f3, allowing the toner to be discharged.

In comparison, referring to FIGS. 11(*a*)–11(*c*), when the toner supply container 5 has already been mounted in the apparatus main assembly 100, the toner outlet hole shutter 5f3 has not rotated, and is rotatable. As the process cartridge 1 is inserted in the direction indicated by an arrow mark in the drawing, the guide pin 1*e*4 of the process cartridge 1, on the leading end of the process cartridge 1 in terms of the process cartridge insertion direction, engages into the slit 5f3c of the toner outlet hole shutter 5f3 (FIG. 11(*a*)). In this state, the first hole 5f5 is closed by the toner outlet hole shutter 5f3, since the position of the second hole 5f3b is 90° apart from the position of the first hole 5f5 in terms of the rotational phase of the toner outlet hole shutter 5f3.

As the process cartridge 1 is further inserted, the toner outlet hole shutter 5f3 begins to be rotated in the direction indicated by an arrow mark a about the rotational axis 5f3a (FIG. 11(*b*)). By the time the process cartridge 1 is inserted to its final mounting position, the toner outlet hole shutter 5f3 is rotated to the position shown in FIG. 11(*c*), at which the first hole 5f5 of the toner supply container 5 aligns with the second hole 5f3b f the toner outlet hole shutter 5f3, allowing the toner to be discharged.

When the process cartridge 1 and toner supply container 5 are in the state shown in FIGS. 11(*c*) and 11(*f*), the first hole 5f5 of the toner supply container 5 and the toner inlet hole 1b1 of the process cartridge 1 are in alignment with each other, which is obvious.

Further, the shutter holding member 5f2 is attached to the bottom plate 5i of the toner supply container 5 in such a manner that it is allowed to make slight vertical movement and/or tilt relative to the bottom plate 5i as described above. Therefore, while the toner supply container 5 or process cartridge 1 is inserted, the shutter holding member 5f2 makes slight vertical movement and/or tilts to conform to the shape of the sealing member 1e3 (FIG. 10) to remain airtightly in contact with the sealing member 1e3. Therefore, toner does not scatter outward of the container.

Incidentally, if the toner outlet hole shutter 5f3 is the only structural component for preventing toner from leaking from the toner outlet portion 5f, it is impossible to completely prevent the toner particles, which have adhered to the wall of the second hole 5f3b of the toner outlet hole shutter 5f3, from leaking. Further, if the toner outlet cover 5f1 is the only structural component for preventing the toner leakage, there is a possibility that the toner leakage will occur, since the toner outlet cover 5f1 might be moved to its open position due to the operational errors or the like by a user.

However, according to the present invention, the toner supply container 5 is provided with both the toner outlet hole shutter 5f3 and toner outlet cover 5f1. In other words, the toner leakage preventing means is given a fail-safe structure. Therefore, the toner particles which have adhered to the wall of the second hole 5f3b do not leak outward since they are prevented by the toner outlet cover 5f1 from leaking outward. Further, there is no possibility that the toner outlet portion 5f will be exposed due to the operational error or the like, since the slits 5f3c, that is, the engagement portions, for rotationally driving the toner outlet hole shutter 5f3 are covered with the toner outlet cover 5f1.

Figure 12:
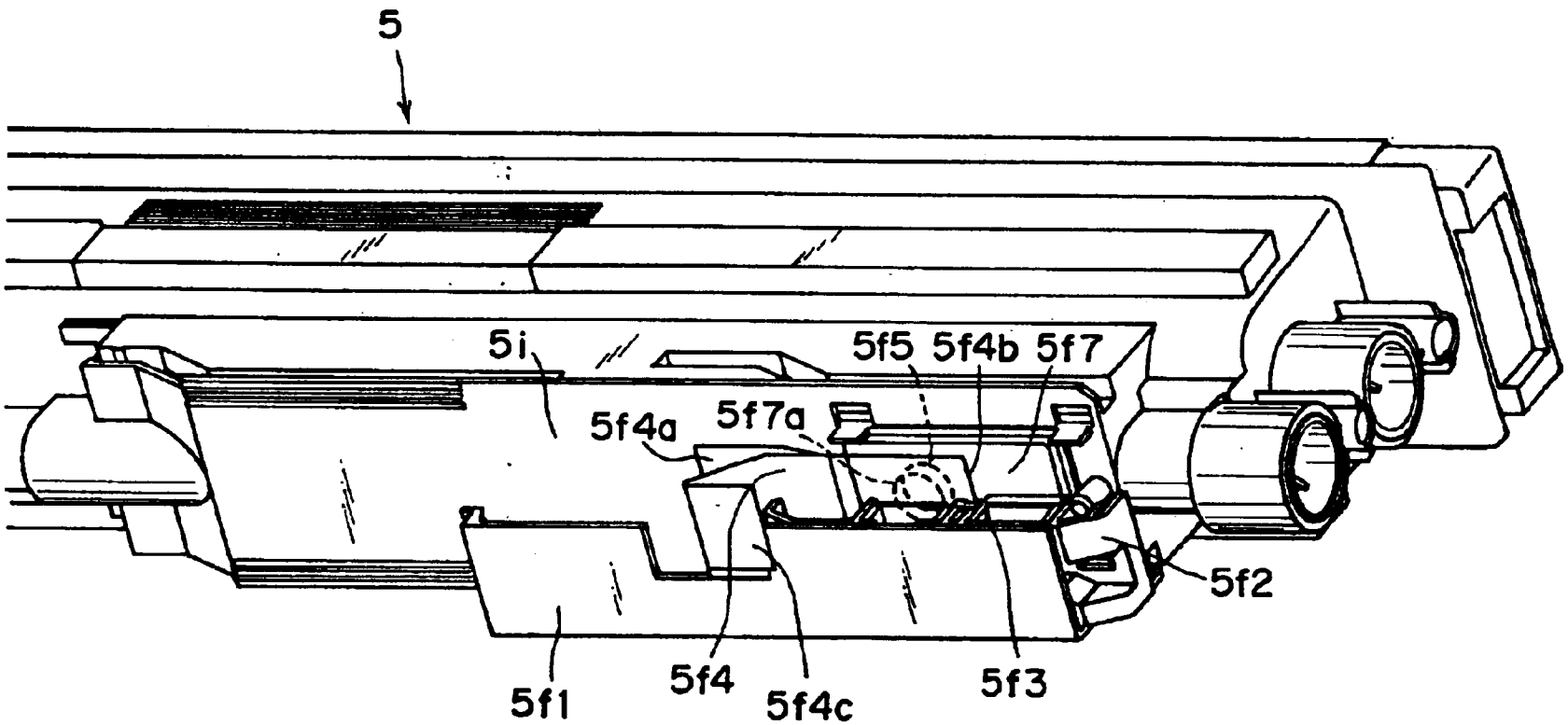
FIG. 12 is an enlarged perspective view of the toner outlet portion of the toner supply container in accordance with the present invention, in which the toner outlet hole cover is closed.
Figure 13:
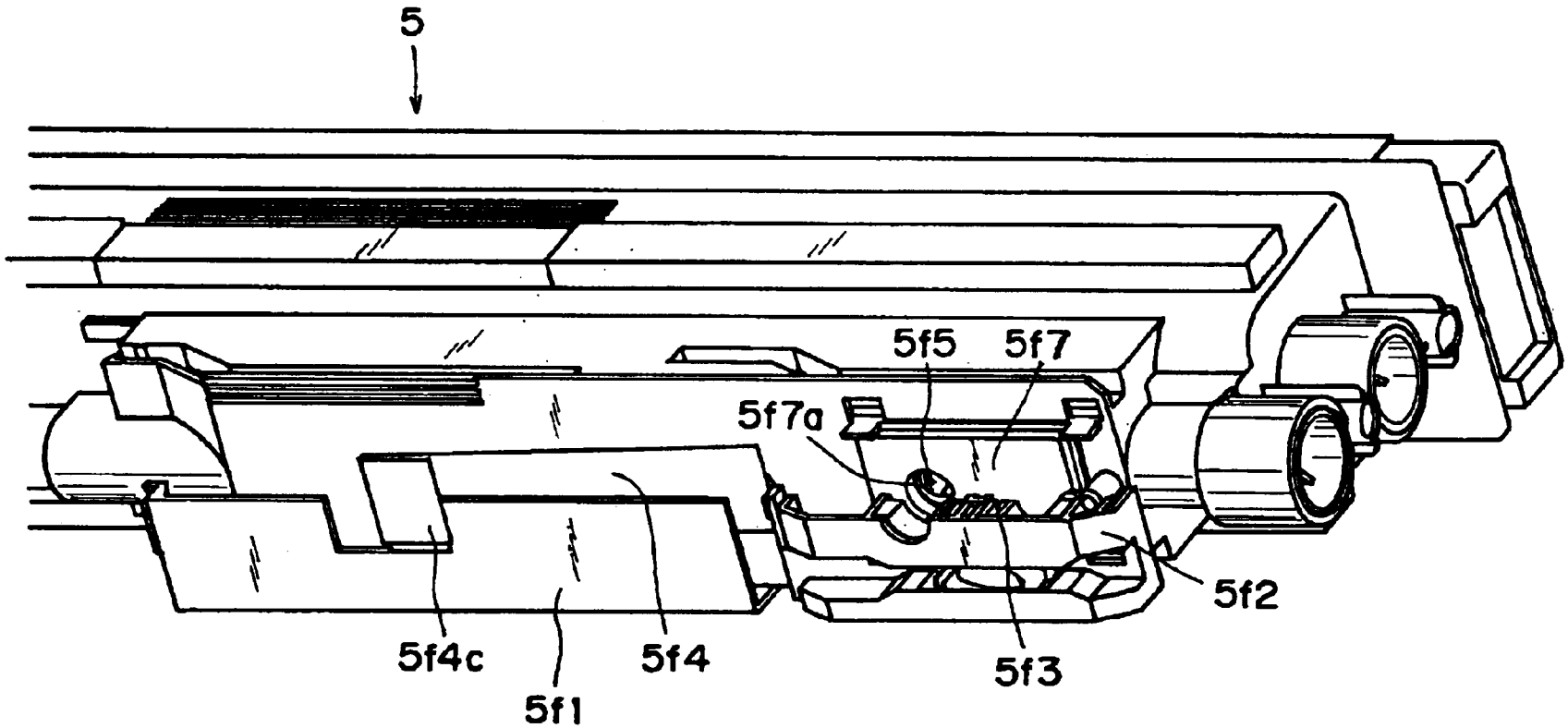
FIG. 13 is an enlarged perspective view of the toner outlet portion of the toner supply container in accordance with the present invention, in which the toner outlet hole cover is open.

FIGS. 12 and 13 are enlarged perspective view of a brand-new toner supply container 5 in this embodiment, as seen from diagonally below the bottom, right, rear corner thereof. In FIG. 12, the toner outlet hole shutter 5f3 and toner outlet cover 5f1 of the toner supply container 5 are closed, whereas in FIG. 13, they are open. In the two drawings, the halves of the toner outlet portion 5f1 and shutter holding member 5f2, and toner outlet hole shutter 5f3, with respect to their center lines parallel to the lengthwise direction of the toner supply container 5, have been hypothetically cut away for visual confirmation.

Referring to FIG. 12, when the toner supply container 5 is brand-new, the toner outlet portion 5f1 and toner outlet hole shutter 5f3 are closed, and the peripheries of the first hole 5f5 of the toner outlet portion 5f are covered with the sealing member 5f6, to which the sealing plate 5f7 has been pasted. The opening of the third hole 5f7a of the sealing plate 5f7 is hermetically sealed with a peelable, flexible sealing tape 5f4 pasted to the surface of the sealing plate 5f7 and its adjacencies. The sealing tape 5f4 is positioned between the sealing plate 5f7 and sealing member 5f8 (FIG. 16). More specifically, one end 5f4a of the sealing tape 5f4 is fixed to the bottom plate 5i of the toner supply container 5, and is peelably pasted or welded to the peripheries of the third hole 5f7a to seal the third hole 5f7a. Then, it is folded back at a folding line 5f4b, being doubled back across the portion of the tape 5f4, which is sealing the third hole 5f7a. Then, the other end 5f4c is fixed to the toner outlet cover 5f1.

As described before, as the toner supply container 5 is inserted into the apparatus main assembly 100, the toner outlet cover 5f1 is moved to the open position by being guided by the grooves 5h and 5h'. Therefore, the sealing tape 5f4 is peeled, starting from the folding line 5f4b, and the third hole 5f7a is exposed, as shown in FIG. 13. Once the sealing tape 5f4 is peeled, it does not return between the sealing plate 5f7 and sealing member 5f8 even when the toner outlet cover 5f1 is returned to the closed position.

With the employment of the above described structural arrangement, the third hole 5f7a remains hermetically sealed with the sealing tape 5f4 during the period in which the toner supply container 5 is shipped to a user or a service person after its manufacture, and is inserted into the apparatus main assembly 100. Therefore, the toner within the toner supply container 5 does not leak even if the toner supply container 5 is subjected to impacts or vibrations of a large magnitude.

Further, the sealing tape 5f4 is automatically peeled away as the toner supply container 5 is inserted into the apparatus main assembly 100. Therefore, the provision of the sealing tape 5f4 does not interfere with the operational efficiency for a user. Further, the locus of the toner outlet cover 5f1 given the function of peeling away the sealing tape 5f4 as described above is regulated by the grooves 5h and 5h'. Therefore, when the sealing tape 5f4 is peeled away, it is not pulled in an unpredicted direction. Thus, it does not occur that the components in the adjacencies of the sealing tape 5f4 are damaged by the sealing tape 5f4 as the sealing tape 5f4 is pulled in an unpredicted direction, or that the force necessary to peel the sealing tape 5f4 increases as the sealing tape 5f4 is pulled in an unpredicted direction.

Next, the characteristics and effects of the above described apparatus will be concisely described.

(1) The toner outlet portion of a toner supply container is provided with a cover enabled to be moved to at least two positions: first position where the cover covers the toner outlet portion, and second position where the cover exposes the toner outlet portion. The toner supply container is provided with grooves for guiding the cover from the first position to the second position, and the cover is engaged with the grooves. Each guiding groove of the toner supply container is provided with at least a first portion which runs virtually in parallel to the direction in which the toner supply container is inserted into the main assembly of an image forming apparatus, and a second portion which runs in the direction to move away from a process cartridge, that is, a developing means, in accordance with the present invention. When the toner supply container is inserted into the apparatus main assembly, the cover moves following the guiding grooves of the toner supply container, and exposes the toner outlet portion, while retracting away from the process cartridge, as the toner supply container is completely inserted. Thus, the cover does not encroach into the process cartridge mounting space as it is retracted to expose the toner outlet portion; the space into which the cover is retracted does not affect the process cartridge mounting space. In other words, the internal space of the toner supply container is optimally utilized to minimize the apparatus main assembly 100.

(2) The toner outlet portion is provided with a shutter for opening or closing the toner outlet hole, and the shutter is provided with at least an engagement portion for opening or closing the shutter. When the cover is at the first position where the cover covers the toner outlet portion, the cover covers the entireties of the engagement portions of the shutter and the entirety of the toner outlet portion. Therefore, not only are the toner particles, which have adhered to the shutter, prevented from leaking, but also the shutter is prevented from being opened by operational errors.

(3) The toner supply container is provided with a peelable sealing tape for hermetically sealing the toner outlet hole, and one end of the sealing tape is fixed to the cover. As the cover is moved by the insertion of the toner supply container into the apparatus main assembly, the sealing tape is automatically peeled away to unseal the toner outlet hole. In other words, the sealing tape is peeled away simply by the insertion of the toner supply container into the apparatus main assembly by a user, rendering less inconvenient the toner supply container mounting operation. Further, the direction in which the sealing tape is pulled to be peeled is regulated by the locus of the cover. Therefore, the problem that a user pulls the sealing tape in an unpredicted direction to peel the sealing tape does not occur. Thus, it does not occur that, because the sealing tape is pulled in an unpredicted direction by a user, the components in the adjacencies of the sealing tape are damaged by the sealing tape, or the force necessary to peel the sealing tape increases.

(4) The process cartridge as a developing means in this embodiment is structured so that it can be inserted into, or pulled out of, the main assembly of an image forming apparatus. Further, the aforementioned cover in this embodiment is structured so that it is retracted as the process cartridge is inserted. These structural arrangements are highly effective for the following reasons. That is, if the cover is not retracted as described above, it is necessary for the process cartridge to be structured so that the toner inlet portion of the process cartridge can be retracted to prevent it from interfering with the cover. This makes complicated the toner inlet portion of the process cartridge. Thus, the employment of the toner supply container structure in accordance with the present invention, in which the cover is retracted in a manner to move away from the process cartridge, makes it possible for both the toner supply container and process cartridge to be inserted into, or removed from, the apparatus main assembly, and also simplifies the overall structure of the image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A developer supply container detachably mountable to a main assembly of an image forming apparatus, said container comprising:

a developer accommodating portion;

a developer discharging portion including a hole through which a developer passes and a shutter for closing and opening said hole; and a cover covering said developer discharging portion, said cover being movable between a first position in which said cover covers said developer discharging portion and a second position in which said developer discharging portion is exposed, wherein the second position is closer to said developer accommodating portion than the first position, and wherein said cover moves from the first position to the second position in accordance with said container being inserted into the main assembly of the apparatus.

2. A container according to claim 1, further comprising a rail for guiding movement of said cover, said rail including a first guiding portion for guiding said cover to move in parallel with said developer accommodating portion and a second guiding portion for guiding said cover toward said developer accommodating portion.

3. A container according to claim 1, further comprising urging means for urging said cover to the first position when said container is out of the apparatus.

4. A container according to claim 1, further comprising a tape, which seals said hole when said container has not been used, wherein said tape has one end fixed to said cover, and wherein said tape is peeled off when said cover is first moved from the first position to the second position.

5. An image forming apparatus comprising:

an image bearing member;

developing means for developing a latent image formed on said image bearing member; and developer supply container detachably mountable to a main assembly of said apparatus, said container including;

a developer accommodating portion;

a developer discharging portion including a hole through which a developer passes and a shutter for closing and opening the hole; and a cover covering said developer discharging portion, said cover being movable between a first position in which said cover covers said developer discharging portion and a second position in which said developer discharging portion is exposed, wherein the second position is closer to said developer accommodating portion than the first position, and wherein said cover moves from the first position to the second position in accordance with said container being inserted into said main assembly of said apparatus.

6. An apparatus according to claim 5, further comprising a rail for guiding movement of said cover, said rail including a first guiding portion for guiding said cover to move in parallel with said developer accommodating portion and a second guiding portion for guiding said cover toward said developer accommodating portion.

7. An apparatus according to claim 5, further comprising a projection for being abutted by said cover, wherein when said container is mounted to said main assembly of said apparatus, said cover abuts said projection so that movement of said cover is regulated, and wherein said cover moves from the first position to the second position with an action of mounting said container to said apparatus.

8. An apparatus according to claim 5, further comprising a tape, which seals said hole when said container has not been used, wherein said tape has one end fixed to said cover, and wherein said tape is peeled off when said cover is first moved from the first position to the second position.

9. An apparatus according to claim 5, wherein at least said developing means is detachably mountable to said main assembly of said apparatus, and wherein said shutter is movable in response to a relative movement between said container and said developing means.

10. An apparatus according to claim 9, wherein said image bearing member is detachably mountable to said main assembly of said apparatus together with said developing means.

* * * * *